US007493061B2

(12) United States Patent
Hatori et al.

(10) Patent No.: US 7,493,061 B2
(45) Date of Patent: Feb. 17, 2009

(54) PROCESS CARTRIDGE INCLUDING AT LEAST ONE REPLACEABLE MEMBER AND IMAGE FORMING APPARATUS

(75) Inventors: Satoshi Hatori, Kanagawa (JP); Kazuhito Watanabe, Kanagawa (JP); Satoshi Narumi, Kanagawa (JP); Shinji Tamaki, Tokyo (JP); Tsutomu Katoh, Kanagawa (JP); Haruji Mizuishi, Tokyo (JP); Tetsuroh Tanigawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/532,979

(22) PCT Filed: Aug. 24, 2004

(86) PCT No.: PCT/JP2004/012445

§ 371 (c)(1),
(2), (4) Date: Apr. 28, 2005

(87) PCT Pub. No.: WO2005/022273

PCT Pub. Date: Mar. 10, 2005

(65) Prior Publication Data

US 2006/0045603 A1 Mar. 2, 2006

(30) Foreign Application Priority Data

| | | |
|---|---|---|
| Aug. 29, 2003 | (JP) | 2003-307168 |
| Jul. 8, 2004 | (JP) | 2004-201252 |
| Jul. 20, 2004 | (JP) | 2004-211004 |

(51) Int. Cl.
*G03G 21/16* (2006.01)

(52) U.S. Cl. ..... 399/111; 399/113; 399/116; 399/119; 399/123

(58) Field of Classification Search ..... 399/111, 399/113, 114, 115, 116, 119, 123
See application file for complete search history.

(56) References Cited

U.S. PATENT DOCUMENTS 4,386,838 A * 6/1983 Hirabayashi et al. ..... 399/113

(Continued)

FOREIGN PATENT DOCUMENTS

JP 59-211054 11/1984

(Continued)

OTHER PUBLICATIONS

U.S. Appl. No. 11/608,175, Dec. 7, 2006, Kuma, et al.

(Continued)

*Primary Examiner*—David M Gray
*Assistant Examiner*—Laura K Roth
(74) *Attorney, Agent, or Firm*—Oblon, Spivak, McClelland, Maier & Neustadt, P.C.

(57) ABSTRACT

A process cartridge is provided with a frame body made up of at least first and second frame bodies that are movable relative to each other to form a space, a frame body positioning member positioning the first and second frame bodies, a latent image bearing member supported by the frame body and replaceable via the space formed by the first and second frame bodies, a developing unit supplying a developing agent to the latent image bearing member, and a developing position determining member. The developing position determining member is disposed at a non-overlapping position relative to the frame body positioning member, and positions the developing unit with respect to the frame body.

35 Claims, 26 Drawing Sheets

U.S. PATENT DOCUMENTS

| | | | | | |
|---|---|---|---|---|---|
| 4,708,455 | A | * | 11/1987 | Kubota et al. | 399/111 |
| 4,816,877 | A | * | 3/1989 | Keen | |
| 5,023,660 | A | * | 6/1991 | Ebata et al. | 399/111 |
| 5,142,322 | A | * | 8/1992 | Surti | 399/113 |
| 5,289,234 | A | * | 2/1994 | Asano et al. | 399/113 |
| 5,328,795 | A | * | 7/1994 | Yamashiro et al. | |
| 5,404,203 | A | * | 4/1995 | Kinoshita et al. | |
| 5,950,047 | A | * | 9/1999 | Miyabe et al. | 399/111 |
| 6,041,203 | A | * | 3/2000 | Suzuki et al. | 399/111 |
| 2002/0122677 | A1 | * | 9/2002 | Noda et al. | |
| 2003/0044201 | A1 | * | 3/2003 | Kosuge | |
| 2003/0091366 | A1 | * | 5/2003 | Saito et al. | 399/111 |
| 2004/0191663 | A1 | * | 9/2004 | Ojima et al. | |

FOREIGN PATENT DOCUMENTS

| | | | | |
|---|---|---|---|---|
| JP | 60-168159 | | | 8/1985 |
| JP | 01-142666 | | | 6/1989 |
| JP | 04-274452 | | | 9/1992 |
| JP | 07-302033 | | | 11/1995 |
| JP | 08-101624 | | | 4/1996 |
| JP | 11-296049 | | | 10/1999 |
| JP | 2000172015 | A | * | 6/2000 |
| JP | 2001-331082 | | | 11/2001 |
| JP | 2002-182493 | | | 6/2002 |
| JP | 2002-311714 | | | 10/2002 |
| JP | 2003-076249 | | | 3/2003 |
| JP | 2003-177651 | | | 6/2003 |
| JP | 2003-186305 | | | 7/2003 |
| JP | 2003-228198 | | | 8/2003 |

OTHER PUBLICATIONS

U.S. Appl. No. 11/855,353, Sep. 14, 2007, Shintani, et al.

* cited by examiner

PROCESS CARTRIDGE INCLUDING AT LEAST ONE REPLACEABLE MEMBER AND IMAGE FORMING APPARATUS

TECHNICAL FIELD

The present invention generally relates to process cartridges and image forming apparatuses, and more particularly to a process cartridge for forming images in a copying apparatus, a facsimile apparatus, a printer or the like by an electrostatic image transfer process, and to an image forming apparatus which uses such a process cartridge.

BACKGROUND ART

In an image forming apparatus, a toner within a developing unit is consumed by the image formation and needs to be supplied. In the case of a two-component developing agent, a magnetic carrier needs to be replaced. Other members within the image forming apparatus, such as a photoconductive body which wears out and deteriorates after a long period of use, a charging unit which becomes dirty due to airborne and scattering toner within the image forming apparatus, and a cleaning blade wears out due to contact with the photoconductive body, also need to be replaced, because images of a character dust, a surface fogging and the like would otherwise be generated. In other words, the members and units described above must be replaced in order to prevent the images of the character dust, the surface fogging and the like from being generated. Accordingly, when the character dust or the like is generated, a service or maintenance person (hereinafter simply referred to as a service person) goes to the setup site of the image forming apparatus of the user, and replaces the members and/or units. However, the durability of each member and unit within the image forming apparatus has improved, and the serviceable life of the developing agent or the like used in the image forming apparatus has also been extended. Consequently, the need for the service person to attend to the maintenance of the image forming apparatus has decreased. On the other hand, when the maintenance person actually attends to the maintenance of the image forming apparatus, it takes an extremely long work time to remove each member or unit within the image forming apparatus and to mount a new member or unit in the image forming apparatus.

Hence, a process cartridge which is detachable with respect to a main body of the image forming apparatus has been proposed. The process cartridge integrally supports a process means such as a charging means, a developing means and a cleaning means. The work time of the service person who attends to the maintenance of the image forming apparatus of the user can be reduced by replacing the process cartridge. In some cases, the user himself can easily replace the process cartridge without requiring the service person to attend to the maintenance by going to the setup site of the image forming apparatus. The serviceable life is different for each member or unit. For example, the serviceable life of the photoconductive body is 10,000 prints to 80,000 prints, the serviceable life of the magnetic carrier in the developing unit is 50,000 prints to 100,000 prints, and the serviceable life of the charting unit is 30,000 prints to 80,000 prints. Conventionally, the user or service person replaces the entire process cartridge regardless of the different serviceable lives of the members and units within the process cartridge. As a result, it is convenient in that the entire process cartridge simply needs to be replaced, but from the point of view of efficiently utilizing the resources, it is inconvenient in that a serviceable member or unit within the process cartridge will be replaced when the serviceable life of one member or unit within the process cartridge ends. From the point of view of the user, there were demands to enable each member or unit usable until the serviceable life thereof ends.

A Japanese Laid-Open Patent Application No. 2003-177651 proposes a process cartridge having a cleaning member which removes residual toner on the photoconductive body, and a removed toner accommodating part which accommodates the removed toner. The removed toner accommodating part is provided with a container-shaped cleaning frame body including a first opening confronting the photoconductive body and a second opening located at a position separated from the first opening, a cleaning member substantially covering the first opening, and a lid frame body provided in a periphery of the second opening. A resilient seal member is provided between the lid frame member and a support part of the cleaning member. According to this proposed process cartridge, the size of both the removed toner container and the process cartridge can be reduced, while accommodating a large amount of toner and improving the amount of removed toner that can be accommodated.

A Japanese Laid-Open Patent Application No. 2003-186305 proposes a process cartridge having assembled therein a latent image bearing member and at least one process unit. A developing agent supply box and a removed developing agent recovery box communicate with a developing housing which accommodates a developing agent. The developing agent supply box is arranged at a position on an upstream side of a latent image write position on the latent image bearing member, and the removed developing agent recovery box is arranged at a position on a downstream side of the latent image write position.

A Japanese Laid-Open Patent Application No. 2001-331082 proposes a process cartridge which integrally includes at least a developing unit, and one of a charging unit, an electrophotography photoconductive body and a cleaning unit of the electrophotography photoconductive body. The process cartridge is detachably loaded with respect to a main body of an image forming apparatus, and has a structure which enables the process cartridge to be hand-held and easily shaken.

A Japanese Published Patent Application No. 7-78667 proposes an image forming apparatus provided with first and second frame bodies, wherein a photoconductive body is removed by turning the frame body.

A Japanese Patent No. 3039693 proposes a process cartridge which enables a charging unit to be removed.

A Japanese Laid-Open Patent Application No. 2003-76249 proposes a process cartridge which integrates a developing unit and a photoconductive unit, wherein the developing unit includes a developing means and a toner container, and the photoconductive unit includes a photoconductive drum, a charging means and a cleaning unit.

A Japanese Laid-Open Patent Application No. 8-101624 proposes a process cartridge which is removed after removing a charging means, when replacing a cleaning blade.

A Japanese Laid-Open Patent Application No. 7-302033 proposes a process cartridge having a notifying means, for notifying a number of time used, and provided on a reusable and replaceable part of a process means.

According to the process cartridges proposed in the 8 documents described above, it is possible to integrally replace each of the constituent elements by taking into consideration the reduced size and extended serviceable life of the constituent elements. However, there was a problem in that the image bearing member and each process means forming the process cartridge cannot be easily replaced.

DISCLOSURE OF THE INVENTION

It is a general object of the present invention to provide a process cartridge and an image forming apparatus, in which the problems described above are suppressed.

A more specific object of the present invention is to provide a process cartridge and an image forming apparatus which enable replacement of a process cartridge itself, integrally comprising a latent image bearing member and each process means or unit, and also enables a user or a service person to easily replace the image bearing member and each process means or unit independently.

Another and more specific object of the present invention is to provide a process cartridge and an image forming apparatus which enable accurate positioning of image forming conditions, even when the image bearing member and each process means or unit are replaced independently.

Still another and more specific object of the present invention is to provide a process cartridge and an image forming apparatus which enable independent replacement of a member of each process means or unit, that is consumed or wears out.

Another and more specific object of the present invention is to provide a process cartridge and an image forming apparatus which enable cleaning even if a toner has a small grain diameter with an approximate spherical shape.

Still another object of the present invention is to provide a process cartridge comprising a frame body made up of at least first and second frame bodies that are movable relative to each other to form a space; a frame body positioning member positioning the first and second frame bodies; a latent image bearing member, supported by the frame body, and replaceable via the space formed by the first and second frame bodies; a developing unit supplying a developing agent to the latent image bearing member; and a developing position determining member, disposed at a non-overlapping position relative to the frame body positioning member, and positioning the developing unit with respect to the frame body.

The developing unit may comprise a developing agent bearing member transporting the developing agent, and a magnet group provided inside the developing agent bearing member, and having a predetermined main pole direction; and the developing position determining member may comprises a positioning member positioning the latent image bearing member and the developing agent bearing member, and an angular positioning member determining the main pole direction of the magnet group with respect to the latent image bearing member.

The process cartridge may further comprise a cleaning unit cleaning residual toner on the latent image bearing member; and a cleaning position determining member, disposed at a non-overlapping position relative to the frame body position determining member and the developing position determining member, and positioning the cleaning unit with respect to the frame body.

The process cartridge may further comprise a cleaning unit cleaning residual toner on the latent image bearing member; and a cleaning position determining member positioning the cleaning unit with respect to the frame body, wherein the cleaning unit is replaceable via the space formed by the first and second frame bodies.

The cleaning unit may comprise a cleaning blade removing residual toner on at least the latent image bearing member, a bias roller controlling an amount of charge of the residual toner, and a recovery roller recovering toner adhered on the bias roller and the cleaning blade; the cleaning position determining member may comprise a blade positioning member positioning the cleaning blade with respect to the frame body, the bias roller and the recovery roller; and the cleaning blade, the bias roller and the recovery roller may be independently replaceable.

The process cartridge may further comprise a charging unit uniformly charging the latent image bearing member, where the charging unit is positioned with respect to the frame body at an non-overlapping position relative to the frame body position determining member, the developing position determining member and the cleaning position determining member.

In the process cartridge, at least one of the latent image bearing member, the cleaning unit, the charging unit and the developing unit may be replaced after removing the process cartridge from a main body of an image forming apparatus.

The latent image bearing member may be inserted with a driving shaft provided in a main body of an image forming apparatus.

The frame body may have a hole part for receiving the driving shaft.

The frame body may comprise a discharge unit and a detection unit.

The discharge unit may comprise an electroluminescence lamp.

The detection unit may comprise a potential sensor detecting a potential of the latent image bearing member, a toner density sensor detecting an amount of toner on the latent image bearing member, and a temperature and humidity sensor detecting a temperature and a humidity within the process cartridge.

The electrical wirings for external connection may be connectable via one location of the process cartridge.

The developing unit may use a toner having an average circularity in a range of 0.93 to 1.00.

The toner may have a ratio of volume average particle size and a number average particle size in a range of 1.05 to 1.40.

The toner may be made up of roughly spherical particles with a ratio $r2/r1$ of a minor axis $r2$ and a major axis $r1$ in a range of 0.5 to 1.0, a ratio $r3/r2$ of a thickness $r3$ and the minor axis $r2$ in a range of 0.7 to 1.0, and satisfying a relationship $r1 \geqq r2 \geqq r3$.

The toner may be made by subjecting a toner material solution to a cross linking reaction and/or an extension reaction within an aqueous medium, where the toner material solution is obtained by dissolving or dispersing, within an organic solvent, at least a polyester prepolymer having a functional group that includes nitrogen atoms, a polyester, a colorant and a mold releasing agent.

The process cartridge may further comprise an accommodating part accommodating the toner or a newly supplied toner.

The process cartridge may be reusable by receiving a supply of toner.

The process cartridge may further comprise an accommodating part accommodating a supplied toner.

A further object of the present invention is to provide an image forming apparatus for visualizing a latent image formed on a latent image bearing member into a toner image, comprising at least one detachable process cartridge described above, wherein at least one of the latent image bearing member and the developing unit is replaceable with respect to the process cartridge.

The image forming apparatus may further comprise an accommodating part accommodating a supplied toner.

Another object of the present invention is to provide a process cartridge comprising a frame body; a latent image bearing member supported by the frame body; a developing unit supplying a toner to the latent image bearing member; a developing position determining member positioning the developing unit with respect to the frame body; a cleaning unit cleaning the toner on the latent image bearing member; and a cleaning position determining member, disposed at a non-overlapping position relative to the developing position determining member, positioning the cleaning unit with respect to the frame body.

The developing unit may comprise a developing agent bearing member transporting a developing agent, and a magnet group provided inside the developing agent bearing member and having a predetermined main pole direction; and the developing position determining member may comprise a positioning member positioning the latent image bearing member and the developing agent bearing member, and an angular positioning member determining the main pole direction of the magnet group with respect to the latent image bearing member.

The frame body may be made up of at least a first frame body and a second frame body that are movable relative to each other to form a space, the latent image bearing member may be supported by the frame body and be replaceable via the space formed by the first and second frame bodies, and the process cartridge may further comprise a frame body positioning member, disposed at a non-overlapping position relative to the developing position determining member, and positioning the first and second frame bodies.

The cleaning unit may be replaceable by removing the cleaning position determining member after the first and second frame bodies are moved relative to each other to form the space.

The cleaning unit may comprise a cleaning blade removing residual toner on at least the latent image bearing member, a bias roller controlling an amount of charge of the residual toner, and a recovery roller recovering toner adhered on the bias roller and the cleaning blade; the cleaning position determining member may comprise a blade positioning member positioning the cleaning blade with respect to the frame body, the bias roller and the recovery roller; and the cleaning blade, the bias roller and the recovery roller may be independently replaceable.

The process cartridge may further comprise a charging unit uniformly charging the latent image bearing member, where the charging unit is positioned with respect to the frame body at an non-overlapping position relative to the frame body position determining member, the developing position determining member and the cleaning position determining member.

Still another object of the present invention is to provide an image forming apparatus for visualizing a latent image formed on a latent image bearing member into a toner image, comprising at least one detachable process cartridge described above, wherein at least one of the latent image bearing member, the developing unit and the cleaning unit is replaceable with respect to the process cartridge.

The image forming apparatus may further comprise an accommodating part accommodating a supplied toner.

A further object of the present invention is to provide a process cartridge configured to be detachable with respect to an image forming apparatus, comprising a latent image bearing member; and at least three process units provided integrally with the latent image bearing member, wherein each of the latent image bearing member and the process units is independently replaceable.

In the process cartridge, the three process units may include a cleaning unit, a developing unit and a charging unit.

Another object of the present invention is to provide a process cartridge configured to be detachable with respect to an image forming apparatus, comprising a frame body; a latent image bearing member supported by the frame body; and at least one process unit provided integrally with the latent image bearing member and supported by the frame body, wherein the latent image bearing member and the at least one process unit are independently replaceable.

The latent image bearing member and the at least one process unit may be replaceable without requiring other process units to be removed.

The latent image bearing member and the at least one process unit may be replaced after removing the process cartridge from the image forming apparatus.

The latent image bearing member may be removable from the frame body without requiring the at least one process unit to be removed from the frame body.

In the process cartridge, a cleaning unit may form one process unit, and the latent image bearing member may be removed from the frame body after rotating the cleaning unit.

The process cartridge may further comprise a cleaning position determining member positioning the cleaning unit with respect to the frame body.

The cleaning unit may comprise a coating mechanism including a coating roller and a lubricant body, wherein the coating mechanism coats a lubricant on the latent image bearing member.

The cleaning unit may comprise a cleaning blade, and the lubricant body is replaceable.

The process cartridge may further comprise a charging unit forming one process unit, wherein the frame body includes a recess that receives the charging unit.

The process cartridge may further comprise a developing unit; and a developing positioning member positioning the developing unit with respect to the frame body.

The developing position determining member may position a developing reference shaft of the developing unit with respect to a hole in the frame body forming a bearing.

The latent image bearing member may receive a driving shaft of the image forming apparatus when the process cartridge is loaded into the image forming apparatus.

The frame body may include a hole forming a bearing and receiving the driving shaft of the image forming apparatus.

The process cartridge may further comprise a discharge unit provided on the frame body; and a detection unit provided on the frame body.

The detection unit may comprise a potential sensor detecting a potential of the latent image bearing member, a toner density sensor detecting an amount of toner on the latent image bearing member, and a temperature and humidity sensor detecting a temperature and a humidity within the process cartridge.

The process cartridge may further comprise an accommodating part accommodating the toner or a newly supplied toner.

The process cartridge may be reusable by receiving a supply of toner.

The process cartridge may further comprise an accommodating part accommodating a supplied toner.

Still another object of the present invention is to provide an image forming apparatus for visualizing a latent image formed on a latent image bearing member into a toner image, comprising at least one detachable process cartridge described above, wherein at least one of the latent image bearing member, the developing unit and the cleaning unit is replaceable with respect to the process cartridge.

The image forming apparatus may further comprise an accommodating part accommodating a supplied toner.

Therefore, according to the process cartridge of the present invention and the image forming apparatus of the present invention, it is possible to replace the process cartridge itself, and to also easily replace the latent image bearing member and each process unit. In addition, it is possible to position the process cartridge with respect to the image forming apparatus using a guide of the image forming apparatus which provides an assembling reference and the position determining member of the process cartridge. Furthermore, it is possible to independently replace parts and units that are consumed or wear out and have different serviceable lives.

Other objects and further features of the present invention will be apparent from the following detailed description when read in conjunction with the accompanying drawings.

BEST MODE FOR CARRYING OUT THE INVENTION

Figure 1:
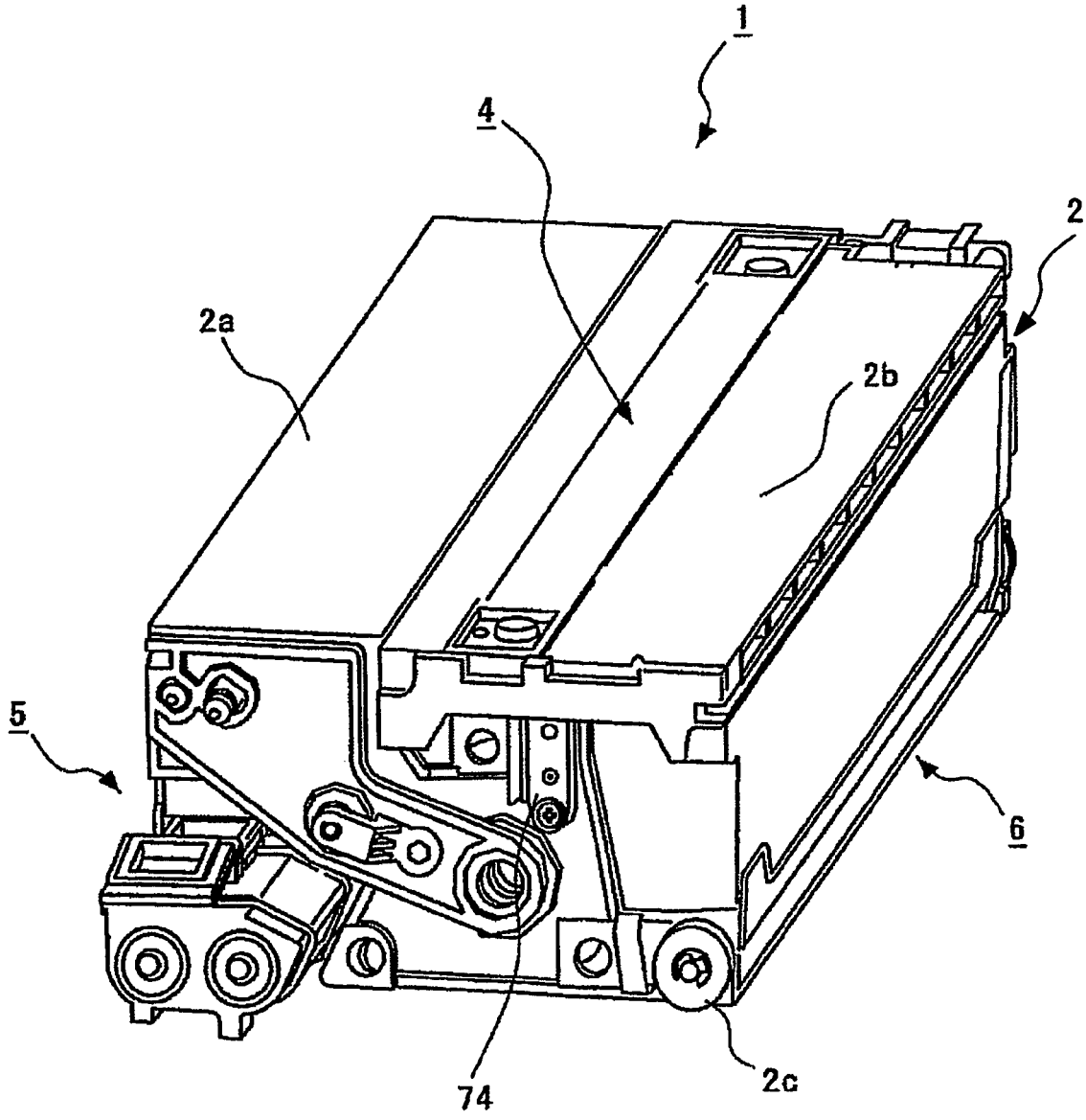
FIG. 1 is a perspective view showing a general structure of an embodiment of a process cartridge according to the present invention.
Figure 2:
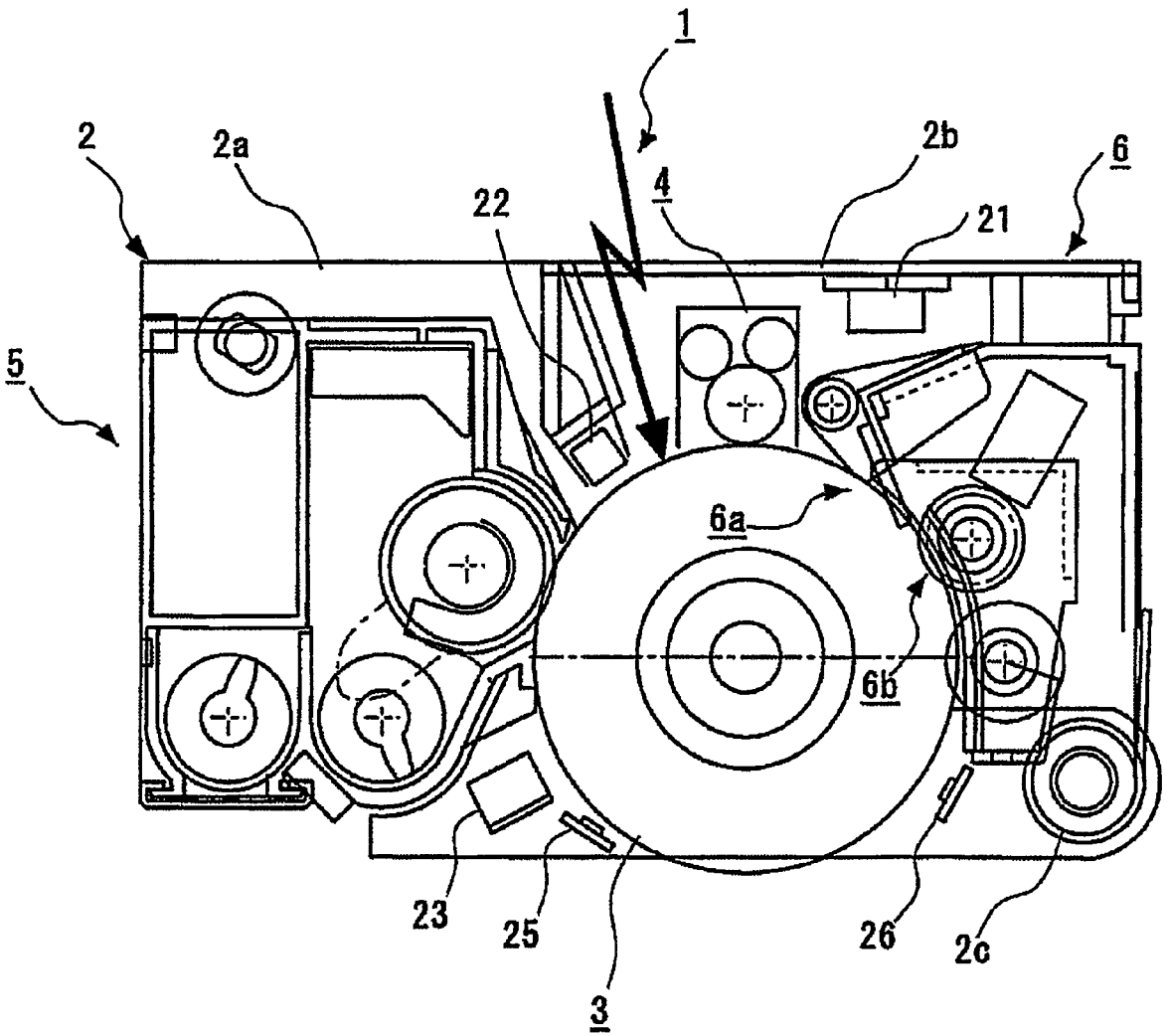
FIG. 2 is a cross sectional view showing the structure of the embodiment of the process cartridge.

FIG. 1 is a perspective view showing a general structure of an embodiment of a process cartridge according to the present invention, and FIG. 2 is a cross sectional view showing the structure of this embodiment of the process cartridge.

As shown in FIGS. 1 and 2, a process cartridge 1 is made up of a process cartridge frame body 2. The process cartridge frame body 2 may have a latent image bearing member, a charging means or unit which is provided as each process means or unit, a developing means or unit, and a cleaning means or unit. For example, the latent image bearing member is formed by a photoconductive body 3, the charging means or unit may be formed by a charging module 4, the developing means or unit may be formed by a developing module 5, and the cleaning means or unit may be formed by a cleaning module 6. The process cartridge 1 itself is replaceable. In addition, in a state where the process cartridge 1 is removed from a main body of an image forming apparatus 100 which will be described later, each of the photoconductive body 3, the charging module 4, the developing module 5 and the cleaning module 6 may be replaced by a new body or module (hereinafter simply referred to as a module). In addition, each module itself may be handled independently by a service person or a user.

Figure 3A:
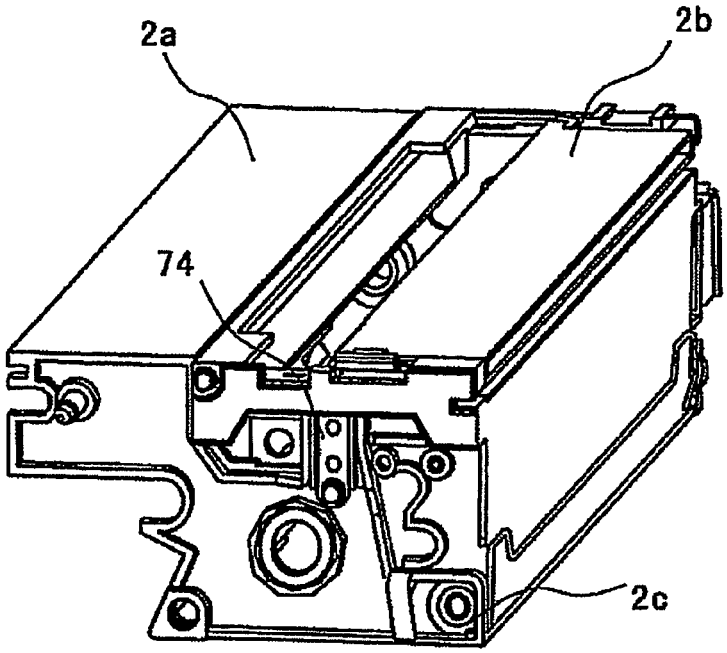
FIGS. 3A and 3B respectively are perspective views viewed from a front side and a rear side of an image forming apparatus, showing a general structure of a process cartridge frame body.
Figure 3B:
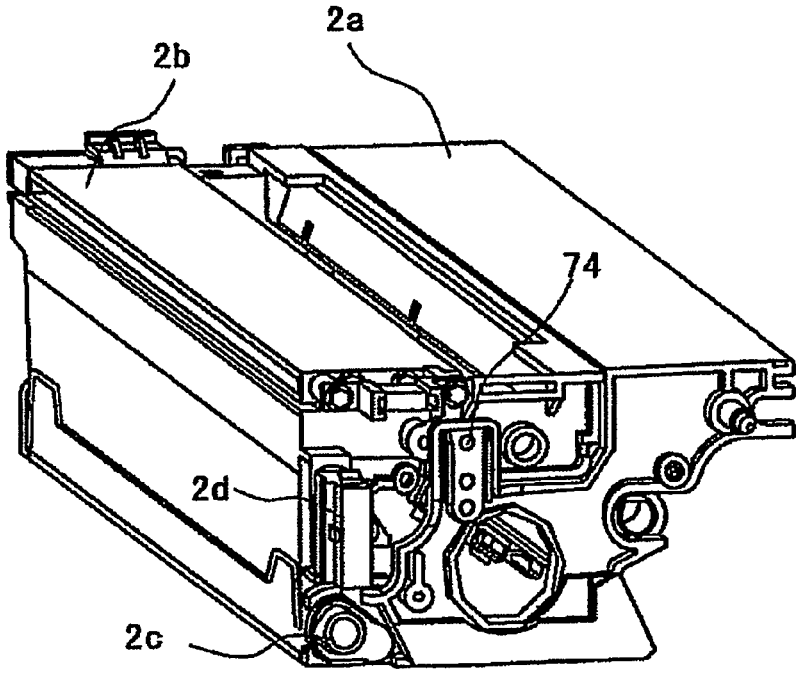

FIGS. 3A and 3B respectively are perspective views viewed from a front side and a rear side of the image forming apparatus 100, showing a general structure of the process cartridge frame body 2.

The process cartridge frame body 2 is made up of a first frame body 2*a* and a second frame body 2*b* which are engaged in a pivottable manner about an engaging part 2*c* which forms a rotary axis, between an open position and a closed position. In the closed position, the first and second frame bodies 2*a* and 2*b* surround the photoconductive body 3 so that the photoconductive body 3 cannot be removed. Projecting portions and hole portions (both not shown) are provided in the respective first and second frame bodies 2*a* and 2*b*, and each projecting portion engages the corresponding hole portion by being inserted through the hole portion. The engaging part 2*c* holds the projecting portion by a ring to prevent the projecting portion from slipping out of the hole portion. Furthermore, 2 pins penetrate a frame body positioning member 74 with respect to an opening that is provided at part where the first and second frame bodies 2*a* and 2*b* overlap in the closed position, so as to simultaneously position and fix the first and second frame bodies 2*a* and 2*b*. Accordingly, the process cartridge frame body 2 can be assembled from the first and second frame bodies 2*a* and 2*b* without having to integrally form the process cartridge frame body 2, and the first and second frame bodies 2*a* and 2*b* can easily be separated. For this reason, the photoconductive body 3 and each process means or unit 4 which will be described later can be replaced independently. In this particular case, the first and second frame bodies 2*a* and 2*b* are pivottable about the engaging part 2*c* which forms the rotary axis, but the first and second frame bodies 2*a* and 2*b* are not limited to this structure. For example, the first and second frame bodies 2*a* and 2*b* may have a structure such that the first and second frame bodies 2*a* and 2*b* are slidable between the open position and the closed position.

The process cartridge frame body 2 may be provided with one or more detecting means or unit, as shown in FIG. 2. The detecting means or unit may include a temperature and humidity sensor 21 for detecting a temperature and a humidity within the process cartridge 1, a potential sensor 22 for detecting a potential of the photoconductive body 3, and a toner density sensor 23 for detecting an amount of toner developed on the photoconductive body 3 after the developing.

The temperature and humidity sensor 21 is arranged on the second frame body 2*b*. The temperature and humidity sensor 21 may detect the temperature and humidity by a detecting element such as a microtemperature sensing element having a positive or negative temperature characteristic. For example, the microtemperature sensing element may be a microstrip, thin film or thermistor made of platinum, tungsten, nichrome or kanthal having a positive temperature characteristic of made of carbon silicide (SiC) or tantalum nitride (TaN) having a negative temperature characteristic. In this particular case shown in FIG. 2, the temperature and humidity sensor 21 is arranged on a top portion of the second frame body 2*b*, but the location of the temperature and humidity sensor 21 on the second frame body 2*b* is not limited to such.

The potential sensor 22 is arranged on the second frame body 2*b*, and is formed by a potential detecting part which may be controlled by a controller within the main body of the image forming apparatus 100. The potential sensor 22 can detect a surface potential of the photoconductive body 3 by being disposed with a gap of 1 mm to 3 mm from the surface of the photoconductive body 3. As shown in FIG. 2, the potential sensor 22 is arranged between the charging module 4 and the developing module 5 in a top portion of the first frame body 2*a*, on a downstream side of an exposing laser beam. In this position, the potential detecting part of the potential sensor 22 detects the potential of the photoconductive body 3 which is formed with a latent image that becomes a patch-shaped solid black part, and a detection signal of the detected potential is sent to the controller of the image forming apparatus 100 via a signal line (or wire harness) 24. The controller of the image forming apparatus 100 determines a magnitude of a developing bias voltage which is to be applied to the developing module 5 based on the detection signal, and applies a suitable developing bias voltage to the developing module 5. Of course, the position of the potential sensor 22 is not limited to that described above. For example, the potential sensor 22 may detect the potential of the photoconductive body 3 which is formed with a latent image that becomes a white background part, and a light quantity (or intensity) and/or exposure time of the laser beam which forms the solid black part may be controlled based on the detected signal.

The toner density sensor 23 is arranged on the first frame body 2*a*. The latent image of the solid black part formed outside an image forming region on the photoconductive body 3 is visualized by the toner, and the amount of adhered toner at the solid black part is optically detected by the toner density sensor 23 as an image tone. A detection signal of the detected amount of adhered toner is sent to the controller of the image forming apparatus 100. The toner density sensor 23 is made up of a light emitting element such as an LED and a light receiving element (both not shown), and detects the amount of adhered toner on the photoconductive body 3 by irradiating light from the light emitting element on the solid black part and detecting the amount of reflected light from the solid black part by the light receiving element. The toner density of the developing agent (or developer) accommodated within the developing module 5 is determined from a table stored in the controller of the image forming apparatus 100 based on the detection signal from the toner density sensor 23. The toner density sensor 23 is arranged on a downstream side of the developing module 5.

By arranging the various sensors related to the photoconductive body 3 on the first frame body 2*a* or the second frame body 2*b*, it becomes possible to easily replace each process means or unit of the process cartridge 1. In addition, it is possible to realize process means or units that are replaceable and inexpensive.

The signal lines (or wiring harnesses) that are not shown are gathered at a rear side of the process cartridge 1, and collectively connected to a connector part 2*d* which is provided on the rear side of the process cartridge 1. The connector part 2*d* connects to a connector part of the main body of the image forming apparatus 100, so as to be electrically connected to an electrical circuit within the main body of the image forming apparatus 100. The signal lines (wiring harnesses) from the various sensors described above reach the connector part 2*d* by being routed along the engaging part 2*c* which forms the rotary axis. Accordingly, the first and second frame bodies 2*a* and 2*b* of the process cartridge frame body 2 can pivot (or turn) freely, to thereby improve the replaceability of each process means or unit.

For example, it is possible to provide a pretransfer discharge unit 25 and a precleaning discharge unit 26. By arranging the pretransfer discharge unit 25 on an upstream side of a transfer region and arranging the precleaning discharge unit 26 on a downstream side of the transfer region and on an upstream side of the cleaning module 6, and attenuating the charge on the photoconductive body 3, the transfer or cleaning is facilitated. Particularly the precleaning discharge unit 26 facilitates the cleaning of the residual toner that is not transferred onto the photoconductive body 3. A light emitting means, such as a laser diode (LD), an LED, an electroluminescence (EL) and fluorescent lamp, may be used for the pretransfer discharge unit 25 and the precleaning discharge unit 26, so as to expose the photoconductive body 3 by the light emitted therefrom and attenuate the charge on the photoconductive body 3. The LD or EL is preferably used for the light emitting means, and it is more preferable to use the EL for the light emitting means due to the simple structure thereof. Of course, a precharging discharge unit may be provided on an upstream side of a charging module 4 to carry out a discharge prior to the charging, so as to erase the residual potential on the photoconductive body 3 and uniformly charge the photoconductive body 3.

Figure 4:
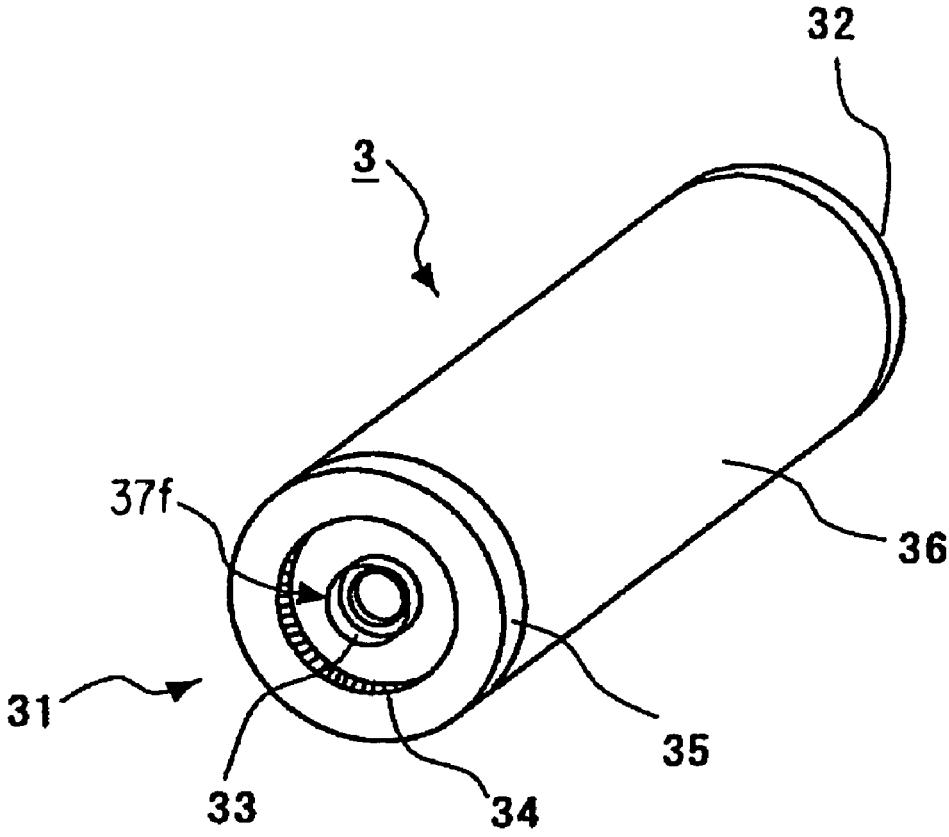
FIG. 4 is a perspective view showing a general structure of a photoconductive body.
Figure 5:
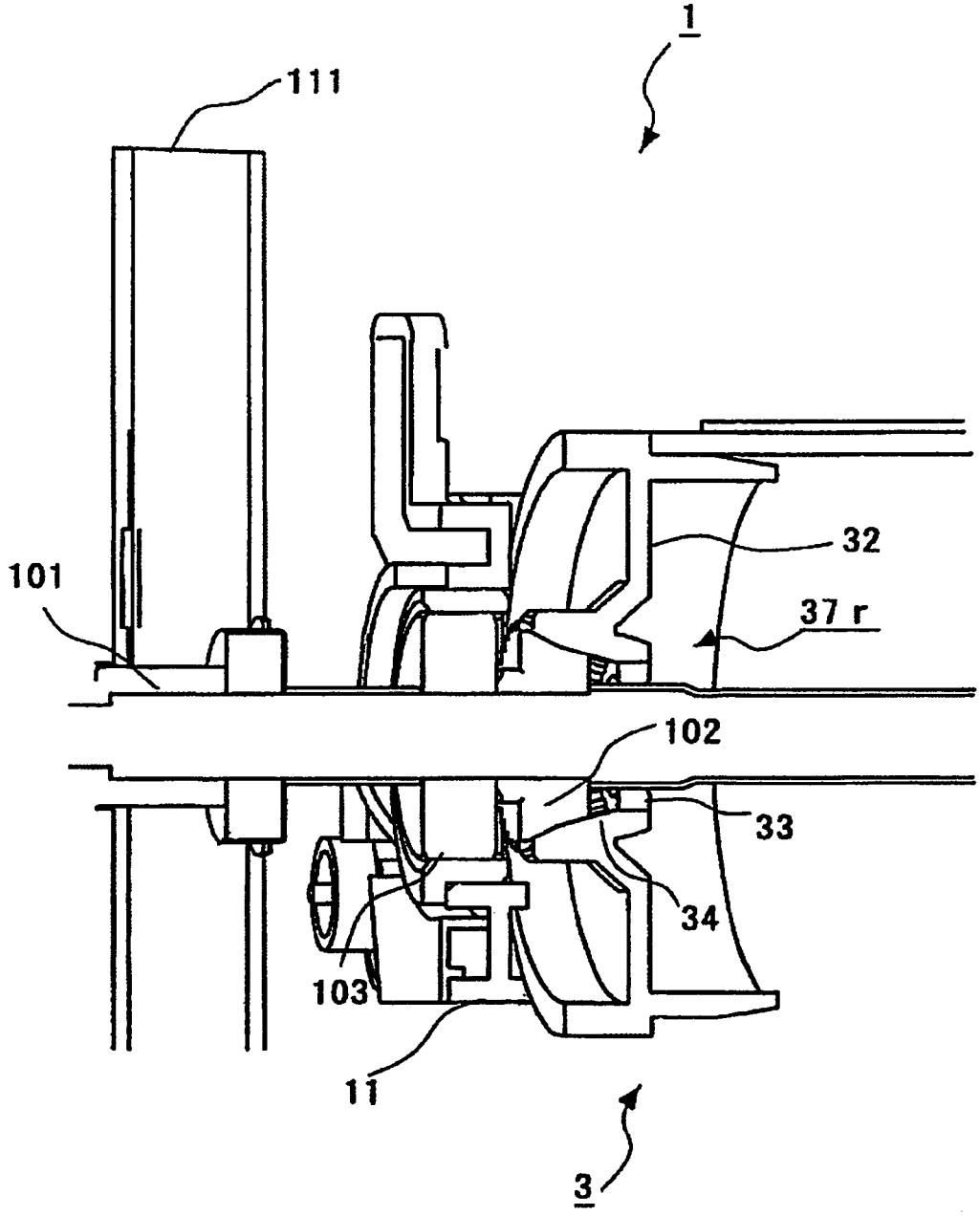
FIG. 5 is a diagram generally showing a state at a rear side of the process cartridge that is assembled into the image forming apparatus.

FIG. 4 is a perspective view showing a general structure of the photoconductive body. FIG. 5 is a diagram generally showing a state at a rear side of the process cartridge that is assembled into the image forming apparatus, and FIG. 6 is a diagram generally showing a state at a front side of the process cartridge that is assembled into the image forming apparatus.

As shown in FIG. 4, the photoconductive body 3 is provided with a photoconductive layer 36 on a cylindrical aluminum substrate 35. In a case where the photoconductive body 3 has a cylindrical shape, flanges 31 and 32 are provided on both ends on an inner portion of the cylinder.

As shown in FIG. 5, a central part of the flange 32 on the rear side of the process cartridge 1 is formed with a bearing 33 for receiving a driving shaft 101 that is provided in the main body of the image forming apparatus 100. Gears 34 are formed on an inner surface of the bearing 33, and the gears 34 mesh with gears 102 provided on the driving shaft 101.

Figure 6:
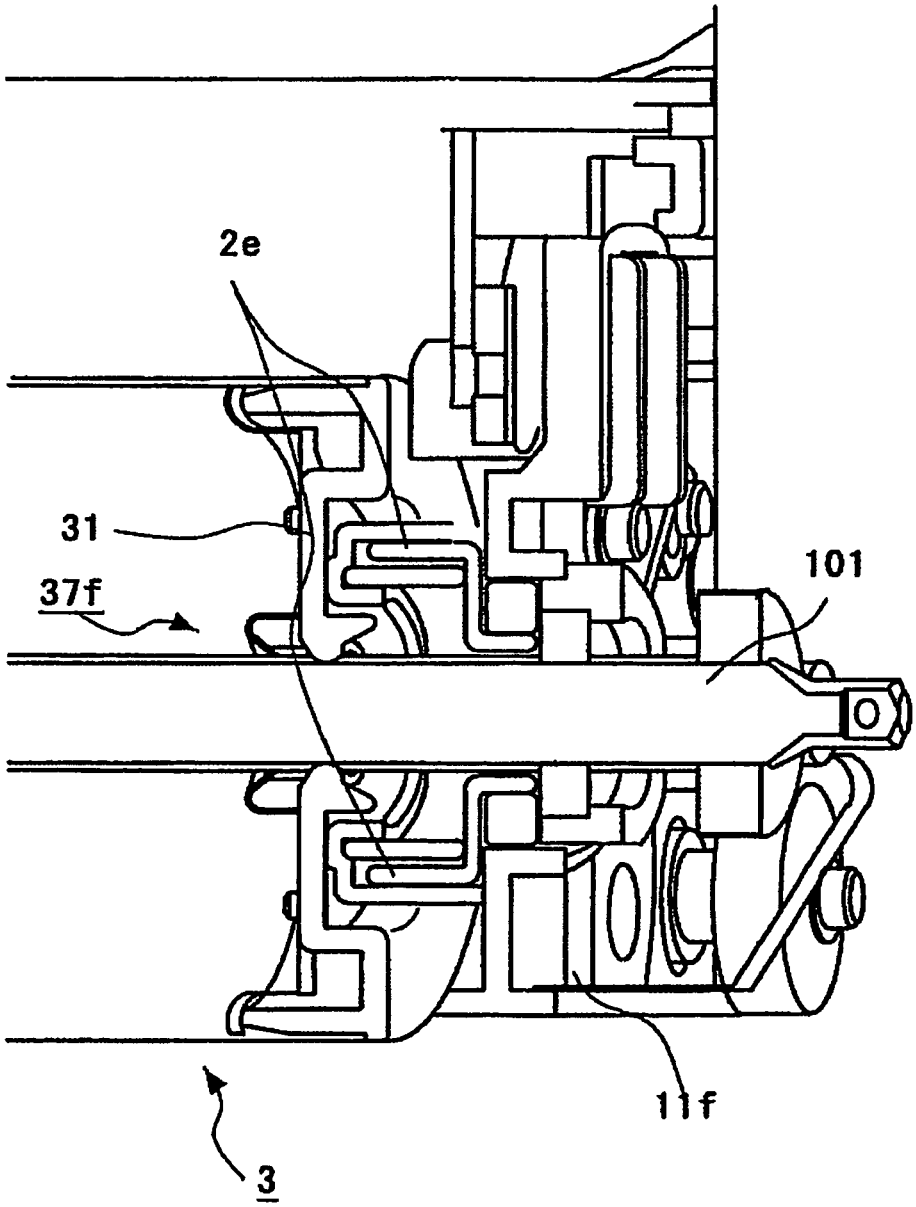
FIG. 6 is a diagram generally showing a state at a front side of the process cartridge that is assembled into the image forming apparatus.

As shown in FIG. 6, a central part of the flange 31 on the front side of the process cartridge 1 is formed with an engaging part 37*f*. When loading the photoconductive body 3 into the process cartridge 1, the engaging part 37*f* engages a positioning part 2*e* that is mounted on the first frame body 2*a*. The positioning part 2*e* is urged by a spring (not shown) in a direction so as to push back the photoconductive body 3. The photoconductive body 3 may be loaded into the process cartridge 1 by loading the photoconductive body 3 into the process cartridge frame body 2 while pushing an engaging part 37*r* of the flange 32 against the positioning part 2*e*, and the photoconductive body 3 can be removed (or unloaded) from the process cartridge 1 in a reverse order. In a state where the photoconductive body 3 is simply supported by a support part 12 that is provided on a side plate 11 of the process cartridge frame body 2, the positioning of the photoconductive body 3 is not highly accurate such that the image formation may be carried out in this state. The image forming apparatus 100 is provided with a bearing 103 on a rear side plate 111*r* of the main body of the image forming apparatus 100, in correspondence with a hole part 13 provided in a rear side plate 11*r* of the process cartridge frame body 2 of the process cartridge 1. The driving shaft 101 fits into the hole part 13 of the process cartridge 1, so as to position the image forming apparatus 100 and the process cartridge 1.

The driving shaft 101 is inserted into the bearing 33 of the flange 31 of the photoconductive body 3, and the gears 102 of the driving shaft 101 mesh with the gears 34 of the flange 31. When the driving shaft 101 which is provided in the main body of the image forming apparatus 100 is rotated, the gears 102 of the driving shaft 101 rotate the photoconductive body 3 via the gears 34 of the photoconductive body 3. In addition, the photoconductive body 3 is not fixed on the support part 11 of the process cartridge 1, and is only supported by the support part 11. The photoconductive body 3 is positioned by fitting the driving shaft 101 of the image forming apparatus 100 into the photoconductive body 3. The driving shaft 101 of the image forming apparatus 100 also simultaneously positions the process cartridge 1 and the photoconductive body 3. In order to drive the photoconductive body 3 with a high accuracy, it is effective to support a rotary shaft of the photoconductive body 3, but in this embodiment, the driving shaft 101 is provided in the main body of the image forming apparatus 100, and the driving shaft 101 penetrates and positions the process cartridge 1. Consequently, it is possible to make the photoconductive body 3 and the process cartridge 1 inexpensive, and also rotationally drive the photoconductive body 3 and the process cartridge 1 with a high accuracy.

Figure 7:
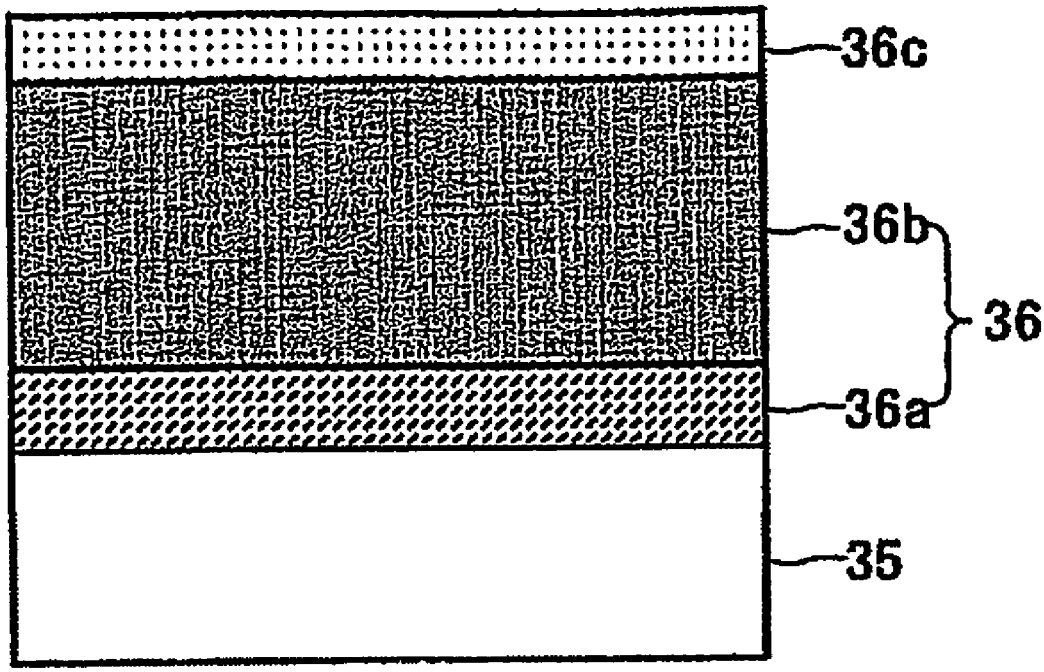
FIG. 7 is a cross sectional view showing a general structure of photoconductive layers of the photoconductive body.

FIG. 7 is a cross sectional view showing a general structure of photoconductive layers of the photoconductive body.

A substrate 35 of the photoconductive body 3 shown in FIG. 7 is made of a metal such as aluminum, copper and steel or an alloy of such metals. The substrate 35 is formed into a generally cylindrical pipe shape by subjecting the metal or metal alloy to a process such as extruding and drawing, and is then subjected to a surface processing such as cutting, superfinishing and polishing so as to form a cylindrical drum.

A photoconductive layer 36 is formed by a charge generating layer 36*a* having a charge generating material as a main component, and a charge transfer layer 36*b* which transfers the generated charge to the surface of the photoconductive body 3 or the substrate 35. The charge generating layer 36*a* may be formed by scattering the charge generating material within a suitable solvent, together with a binding resin if necessary, by use of a ball mill, an attriter, sand mill, ultrasonic wave or the like, and coating the charge generating material on a conductive support to be dried thereon. A known charge generating material may be used for the charge generating layer 36*a*. Typical charge generating materials usable as the charge generating layer 36*a* include mono azo pigment, di azo pigment, tris azo pigment, perylene-based pigment, perynone-based pigment, quinacridone-based pigment, quinone-based condensed polycyclic compound, squalic acid-based dye, phthalocyanine-based pigment, naphthalocyanine-based pigment and azulnenium salt based dye. The azo pigment and/or the phthalocyanine-based pigment is particularly suited for use as the charge generating material.

The charge transfer layer 36*b* may be formed by dissolving or scattering a charge generation (or transport) material and a binding resin into a suitable solvent, and coating the charge generation material on the charge generating layer 36*a* to be dried thereon. A plasticizer, a leveling agent, an antioxidant or the like may be added to the charge generation material if necessary. The charge generation material may be categorized into a hole generation (or transport) material and an electron generation (or transport) material. For example, the charge generation material includes chloranyl, bromanyl and tetracyanoethylene, and the hole generation material includes poly-N-vinylcarbazole and its derivative, poly-γ-carbazoleethylglutamate and its derivative, pyrene-formaldehyde condensed material and its derivative, polyvinylpyrene and polyvinylphenanthrene.

In order to protect the photoconductive layer 36, a protection layer 36*c* may be provided on the photoconductive layer 36. A filler may be added to the protection layer 36*c* for the purposes of improving the wear (or abrasion) resistance. From the point of view of the hardness of the filler, it is advantageous to use an inorganic filler material. Silica, titanium oxide and alumina are particularly effective when used as the inorganic filler material.

Figure 8A:
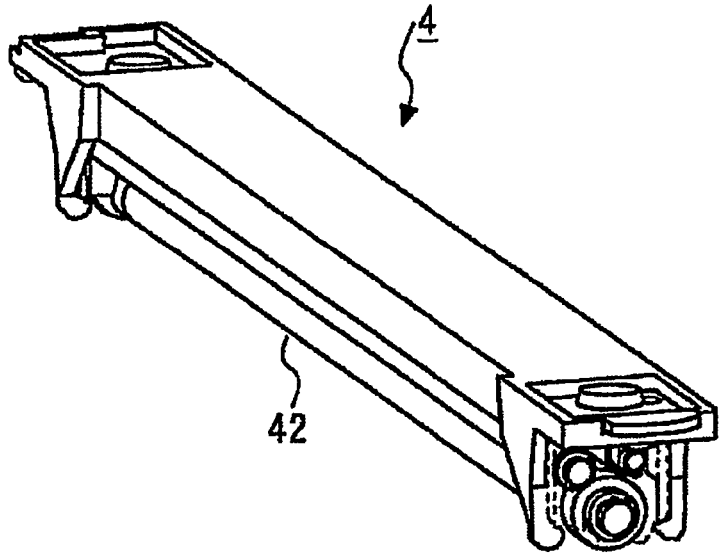
FIGS. 8A and 8B respectively are a perspective view and a side view generally showing a charging module.
Figure 8B:
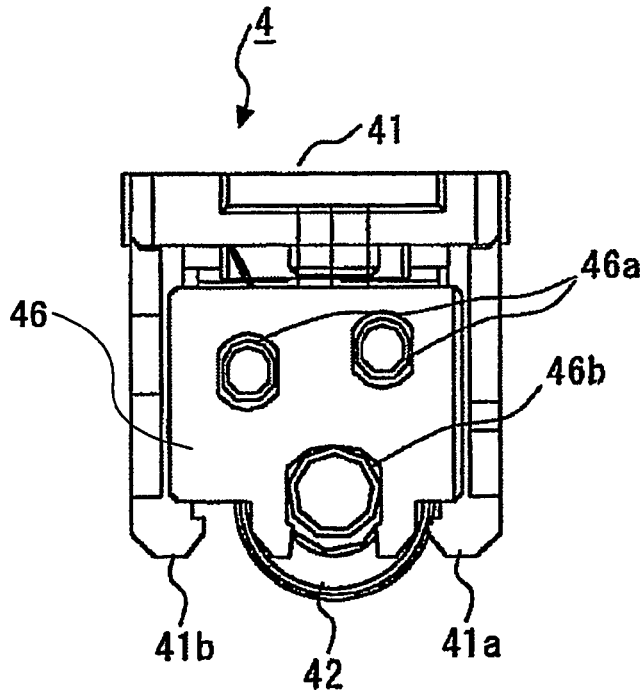
Figure 9:
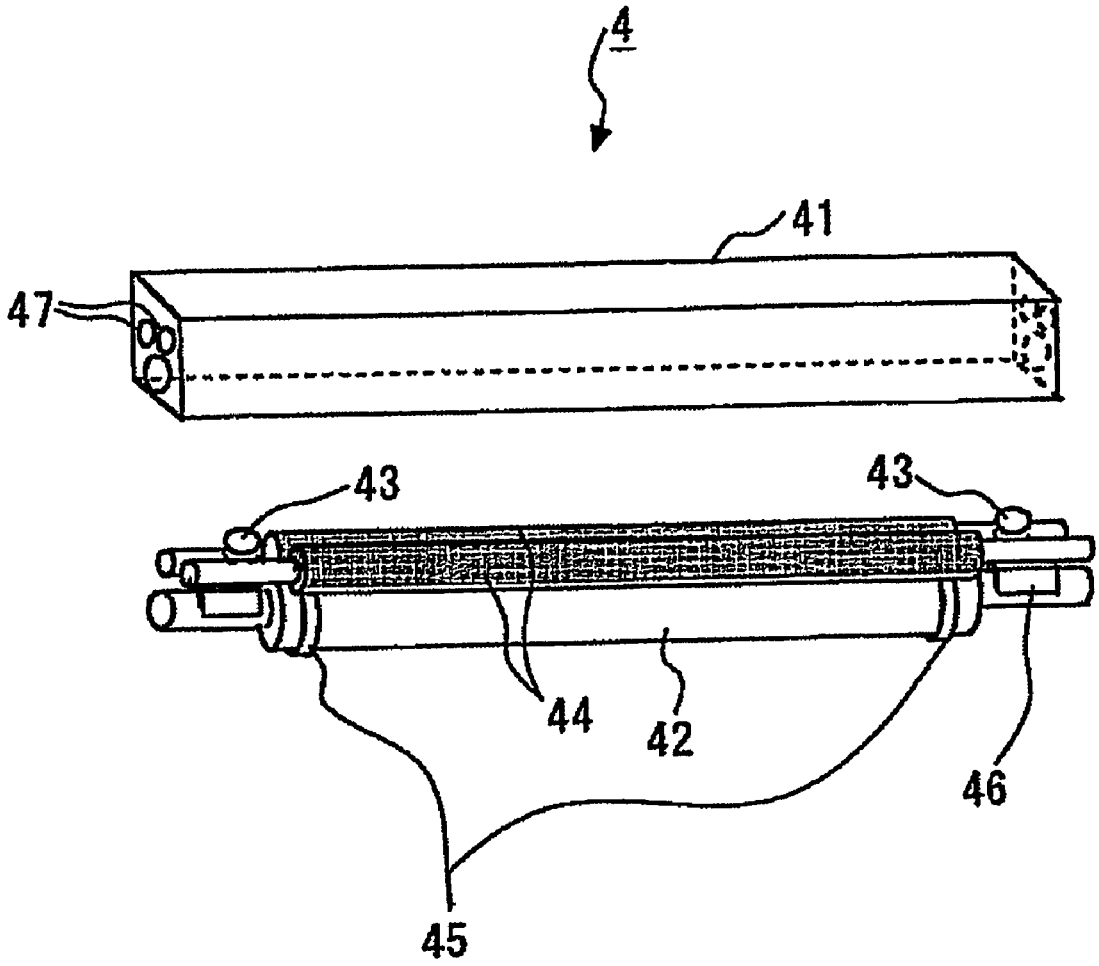
FIG. 9 is a perspective view showing a general structure of the charging module.

FIGS. 8A and 8B respectively are a perspective view and a side view generally showing the charging module. FIG. 9 is a perspective view showing a general structure of the charging module.

As shown in FIGS. 8A, 8B and 9, the charging module 4 includes a charging member 42 which is arranged to confront the photoconductive body 3, charging cleaning rollers 44 which prevent the charging member 42 from vibrating and cleans dirt on spring members 43 and the charging member 42, spacer members 45, support members 46, and a housing 41 which accommodates these members 42 through 46. The charging member 42 and the charging cleaning rollers 44 are rotatably supported by the support members 46. The support members 46 are pushed by the spring members 43 in a direction so as to separate from the housing 41, that is, in a direction towards the rotary axis of the photoconductive body 3, and movements thereof are restricted by restricting members 41*a* which are formed on the housing 41. Hence, by employing the above described structure, when the charging module 4 is loaded into the process cartridge 1, the charging member 42 maintains a suitable distance from the photoconductive body 3 by the provision of the spacer members 45, and in addition, the charging member 42 is prevented from vibrating. The charging module 4, which forms the charting means or unit, is independently replaceable regardless of the loaded or unloaded state of the photoconductive body 3.

Figure 10:
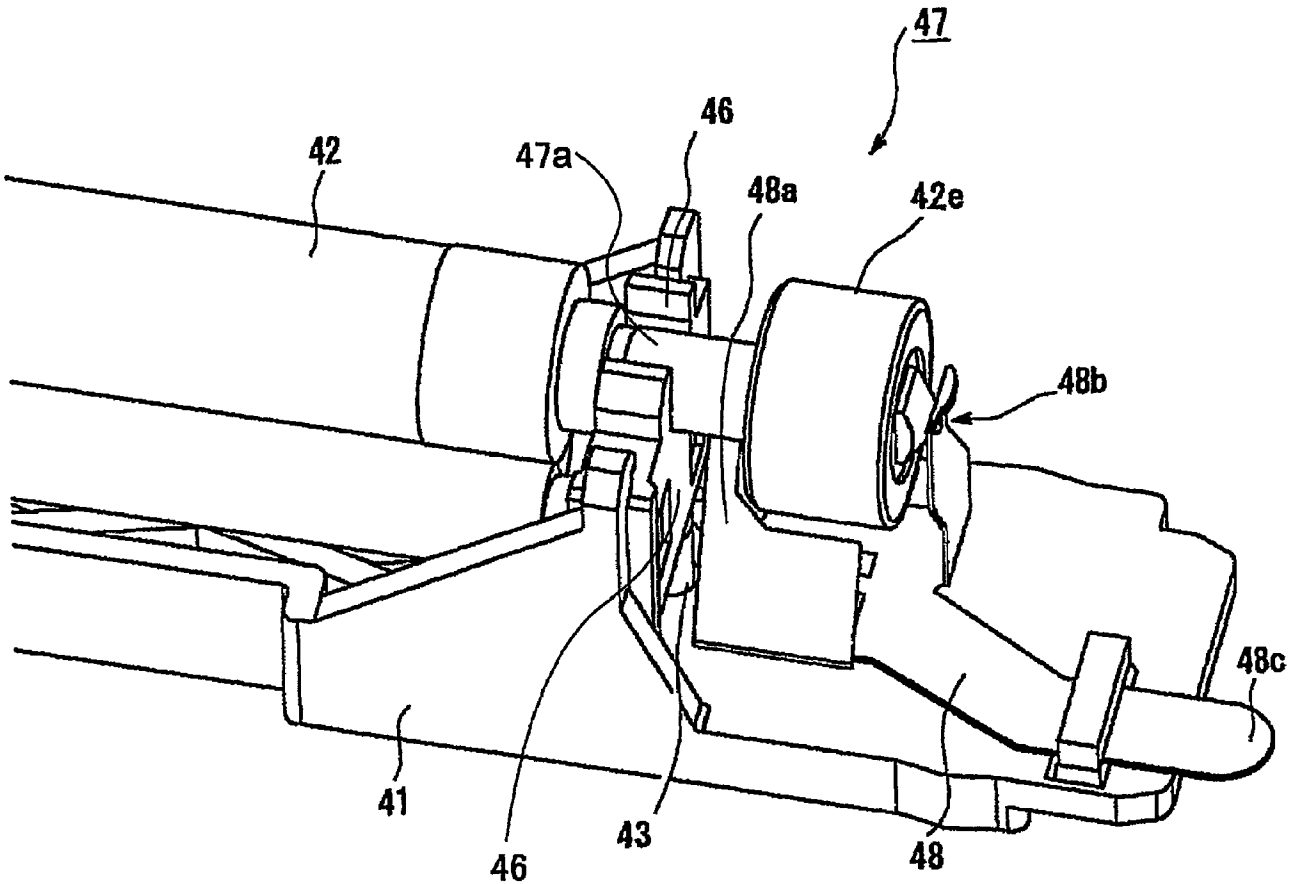
FIG. 10 is a perspective view on an enlarged scale showing a general structure of an electrode part contacting a charging member of the charging module.

FIG. 10 is a perspective view on an enlarged scale showing a general structure of an electrode part contacting the charging member of the charging module.

As shown in FIG. 10, an electrode part 47 is provided on the housing 41 of the charging module 4. The electrode part 47 has a bearing 47*a* which rotatably supports the roller-shaped charging member 42, and a power supply terminal 48 which includes a contact type power supply part 48*c* which connects to a high voltage supply (not shown) provided externally to the process cartridge 1.

The power supply terminal 48 extends along the housing 41 of the charging module 4 in a direction from the contact type power supply part 48*c* towards the charging member 42. A slider type power supply part 48*a* is provided on one end of the power supply terminal 48, and is configured to supply power to a shaft of the charging member 42 while making sliding contact with an outer peripheral surface of this shaft in a state urged against this shaft by the resiliency of the material forming the power supply terminal 48. On the other hand, a slider type power supply part 48*b* is provided on the other end of the power supply terminal 48, and is configured to supply power to the shaft of the charging member 42 while making sliding contact with an end surface of this shaft in a state urged against the end surface of this shaft by the resiliency of the material forming the power supply terminal 48. It is not essential to provide both the slider type power supply parts 48*a* and 48*b*, and only one of the slider type power supply parts 48*a* and 48*b* may be provided. However, it is possible to more positively supply the power by supplying the power via a plurality of parts, when both the slider type power supply parts 48*a* and 48*b* are provided.

A gear 42*e* is fixed on the shaft portion of the charging member 42. In a state where the charging module 4 which will be described later is loaded into the process cartridge 1, the gear 42*e* engages a driving mechanism (not shown) which rotates the charging member 42 via the gear 42*e*. The support member 46 has a support part 46*b* which supports the shaft of the charging member 42. The support member 46 is movable vertically in FIG. 8B along a guide part 41*b* which is provided on the housing 41. The spring member 43 is provided as an urging part between the support member 46 and the housing 4. The support member 46 is pushed by the spring member 43 in the direction so as to separate from the housing 41, that is, in the direction towards the rotary axis of the photoconductive body 3, and the movement of the support member 46 is restricted by the restricting part 41*a* which is formed on the housing 41. By employing the above described structure, the charging member 42 maintains a suitable distance from the photoconductive body 3 by the provision of the spacer member 45, and the charging member 42 is also prevented from vibrating, when the charging module 4 is loaded into the process cartridge 1. Moreover, when removing the charging module 4, it is possible to handle the charging module 4 by itself.

A cleaning mechanism for contacting and cleaning the surface of the charging member 42 is provided within the housing 41 of the charging module 4. In this embodiment, the charging cleaning rollers 44 are provided as the cleaning mechanism. The charging cleaning rollers 44 shown in FIG. 9 are inserted into support parts 46*a* which are provided in the side plates of the housing 41 of the charging module 4 shown in FIG. 8B, and are rotatably supported by the support parts 46*a*. The charging cleaning rollers 44 contact the charging roller 42 and clean the outer peripheral surface of the charging roller 42. When foreign particles such as the toner, paper dust and broken pieces of members adhere on the surface of the charging roller 42, an abnormal discharge may occur. However, such an abnormal discharge can be prevented by cleaning the surface of the charging roller 44 by the charging cleaning rollers 42. Preferably, the charging cleaning rollers 44 have a roller shape shown in FIG. 9 and clean the surface of the charging roller 42 while rotating. Each charging cleaning roller 44 contacts the charging member 42 due to its own weight. However, each cleaning roller 44 may. contact the charging member 42 by being urged by a spring or by being applied with a weight. Of course, the charging cleaning rollers 44 may be formed by a brush member or a continuous porous member.

The gap between the charging member 42 and the photoconductive body 3 is set to 100 μm or less or, preferably in a range of 20 μm to 50 μm by the spacer member 45. By maintaining this gap, it is possible to suppress the formation of an abnormal image when the charging module 4 operates. This gap may be adjusted by a fitting part 15 which fits the process cartridge 1 and the charging module 4. The charging roller 42 is pushed in the direction towards the surface of the photoconductive body 3 by the spring member 43 which is provided on a bearing made of a resin having a low coefficient of friction. Consequently, the above gap can be maintained constant even if mechanical vibrations occur or the core metal deviates.

Figure 11:
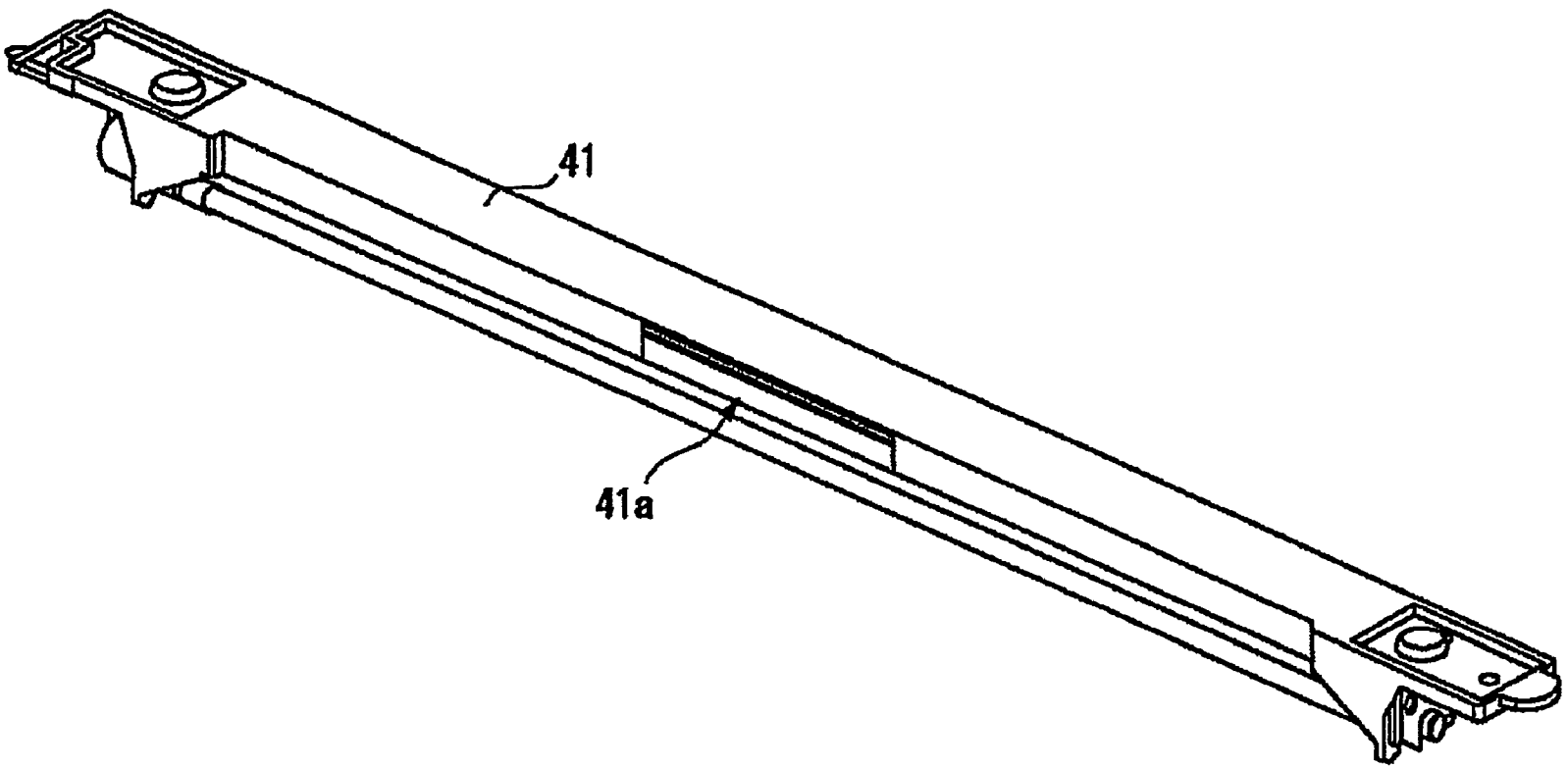
FIG. 11 is a perspective view showing a general structure of the charging module.

FIG. 11 is a perspective view showing a general structure of the charging module. As shown in FIG. 11, a handle part 41*a* is provided approximately at the center part of the housing 41 of the charging module 4. The handle part 41 is formed by a change in geometrical configuration, such as a convex part and/or a concave part, provided on a part of the housing 41, so as to facilitate the handling of the charging module 4 by itself.

Figure 12:
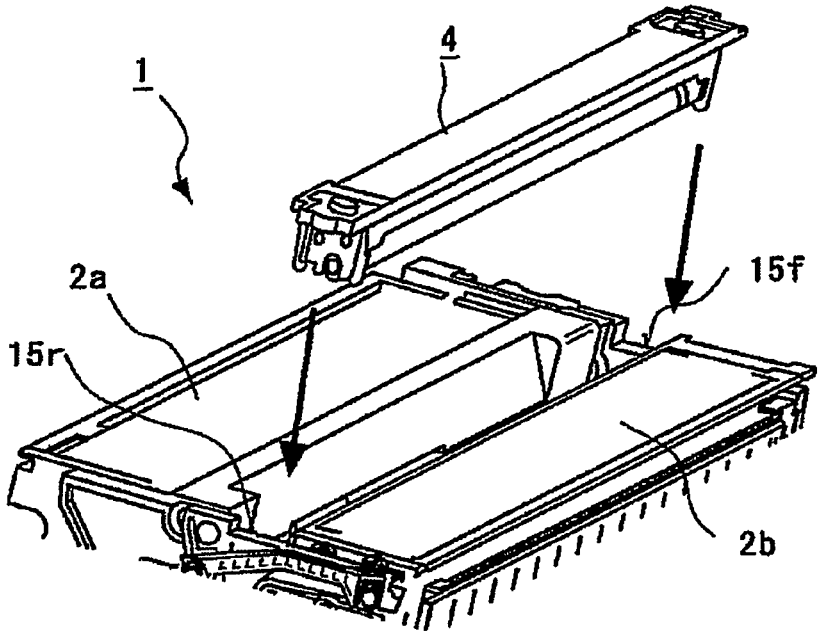
FIG. 12 is a perspective view generally showing a stage where the charging module is loaded into the process cartridge.

FIG. 12 is a perspective view generally showing a stage where the charging module is loaded into the process cartridge. As shown in FIG. 12, the charging module 4 is inserted between fitting parts 15*f* and 15*r* provided on side plates 11*f* and 11*r* of the process cartridge 1. The charging module 4 is positioned by being fitted between the fitting parts 15*f* and 15*r*, and is fixed on the second frame body 2*b*. The reference character "f" affixed to the reference numerals "11" and "15" indicates the front side of the process cartridge 1, and the reference character "r" affixed to the reference numerals "11" and "15" indicates the rear side of the process cartridge 1.

Figure 13:
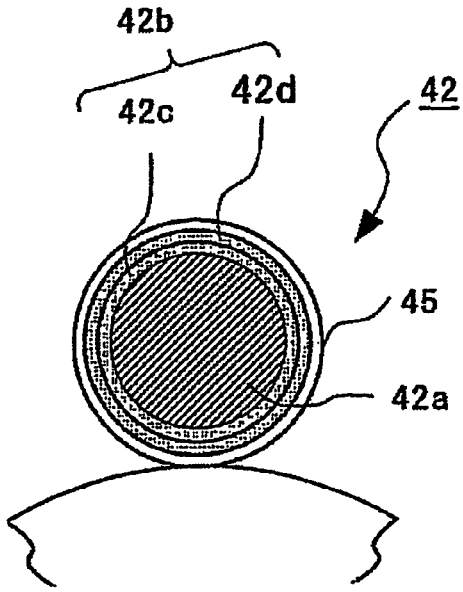
FIG. 13 is a diagram showing general structure of the charging member.

FIG. 13 is a diagram showing general structure of the charging member. The charging member 42 of the charging module 4 may have any suitable structure, but the roller shape is preferable. The charging member 42 shown in FIG. 13 includes a shaft part 42*a* made of a core metal and provided at the center, and a main body part 42*b*. The main body part 42*b* is made up of an intermediate resistor layer 42*c* provided around the shaft part 42*a*, and a surface layer 42*d* provided around the intermediate resistor layer 42*c* and forming the outermost layer. For example, the shaft part 42*a* is made of a metal, such as stainless steel and aluminum, having a high rigidity and high conductivity, with a diameter of 8 mm to 20 mm. Alternatively, the shaft part 42*a* is made of a conductive resin or the like having a high rigidity and a volume resistivity of $1\times10^3$ Ω·cm or less, and preferably $1\times10^2$ Ω·cm or less. Preferably, the intermediate resistor layer 42*c* has a thickness in a range of approximately 1 mm to 2 mm and a volume resistivity in a range of $1\times10^5$ Ω·cm to $1\times10^9$ Ω·cm. Preferably, the surface layer 42*d* has a thickness of approximately 1 μm and a volume resistivity in a range of $1\times10^6$ Ω·cm to $1\times10^{12}$ Ω·cm. It is preferable that the volume resistivity of the surface layer 42*d* is higher than the electrical resistivity of the intermediate resistor layer 42*c*. Although the main body part 42*b* of this embodiment has a two-layer structure made up of the intermediate resistor layer 42*c* and the surface layer 42*d*, the main body part 42*b* is of course not limited to such a structure, and the main body part 42*b* may be formed by a single-layer structure or a multi-layer structure such as a three-layer structure.

Figure 14A:
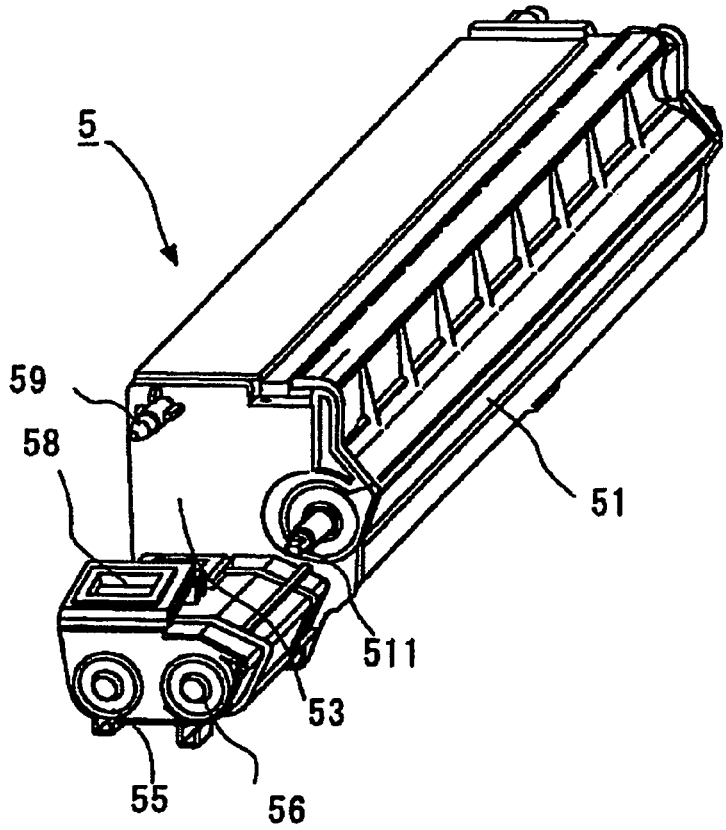
FIGS. 14A and 14B respectively are a perspective view and a side view showing a general structure of a developing module.
Figure 14B:
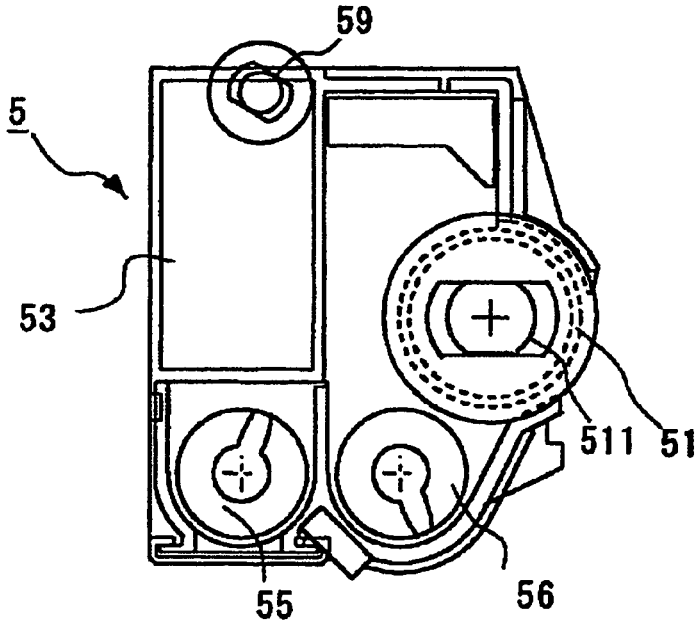

FIGS. 14A and 14B respectively are a perspective view and a side view showing a general structure of the developing module.

The developing module 5 is loaded into the first frame body 2*a* as shown in FIG. 1. The developing module 5 includes a developing sleeve 51 which is arranged close to the photoconductive body 3 and forms a developer bearing member, a magnet group 512 shown in FIG. 16 which will be described later and rotates the developing sleeve 51, a driving shaft 511 provided at the end part of a rotary axis of the magnet group 512 and having a D-shaped cross section for determining an angle of a main pole direction which will be described later, a projecting guide 59, a supply opening 58 through which the toner is supplied from a toner container (not shown) which is provided separately from the developing module 5, a mixing screw 55 for mixing and agitating the supplied toner, and a supply roller 56 for supplying the mixed developing agent to the developing sleeve 51. The above described structure of the developing module 5 enables the developing agent to be supplied to the photoconductive body 3. The magnet group 512 has a predetermined main pole direction indicating a maximum value of a magnetic flux density distribution, and the magnet group 512 is positioned with respect to the photoconductive body 3 with the angle of the main pole direction determined depending on the process conditions of each individual image forming apparatus 100.

Figure 15:
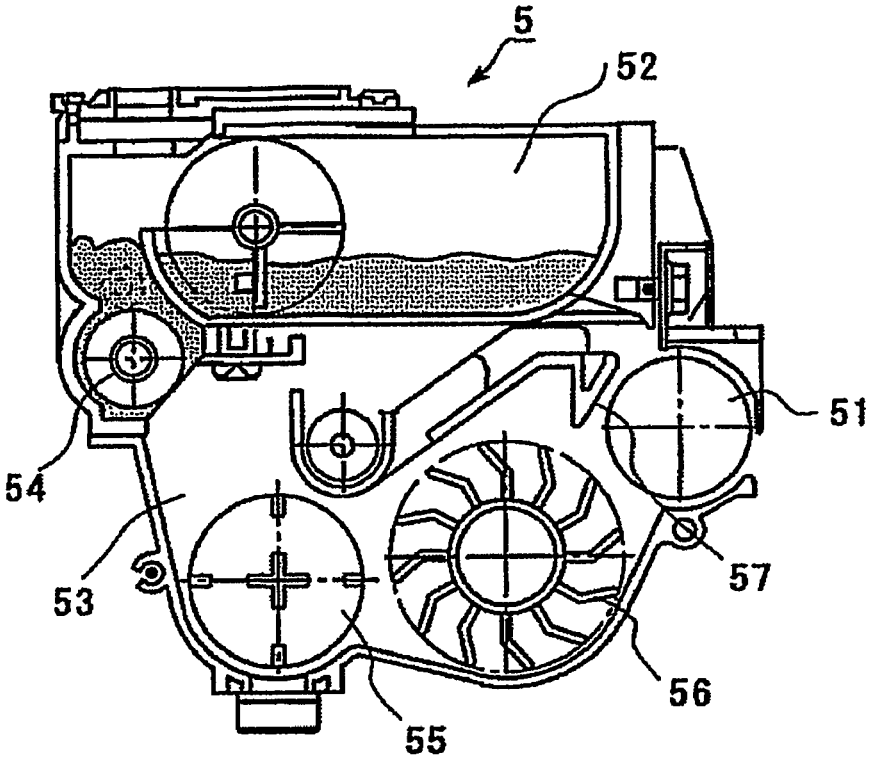
FIG. 15 is a cross sectional view showing another general structure of the developing module.

FIG. 15 is a cross sectional view showing another general structure of the developing module. The developing module 5 shown in FIG. 15 includes a toner hopper 52 for accommodating the tone that is to be supplied, a supply roller 54 for supplying the toner from the toner hopper 52 to a developing agent accommodating part 53, a mixing screw 55 for mixing and agitating the supplied toner and magnetic carriers, a supply roller 56 for supplying the mixed developing agent to a developing sleeve 51, and a restricting member 57 for restricting the amount of developing agent supplied to the developing sleeve 51.

When the developing sleeve 51 rotates, the restricting member 57 that is arranged on an upstream side of a developing region in a transport direction of the developing agent restricts the ear height of the ear of the developing agent chain, that is, the amount of developing agent on the developing sleeve 51. The restricting member 57 and the developing sleeve 51 are accurately positioned to accurately determine a gap between the restricting member 57 and the developing sleeve 51 in the developing region, so that it is possible to form a high-quality image.

Figure 16:
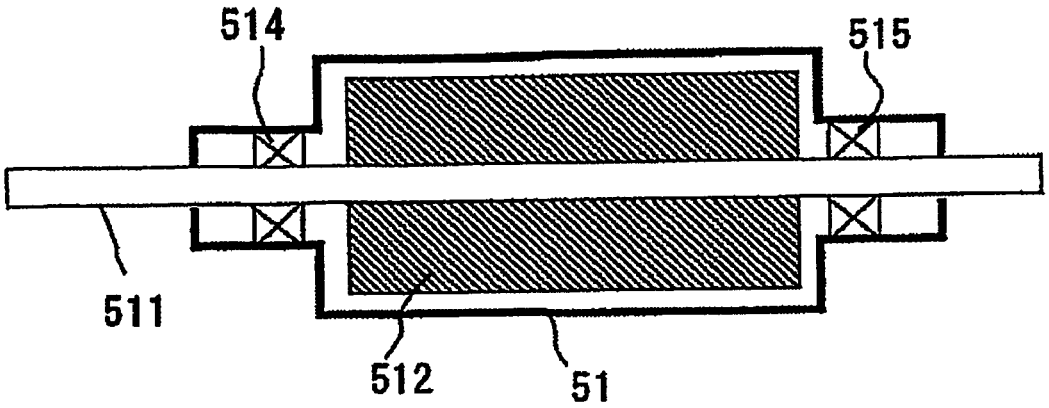
FIG. 16 is a cross sectional view showing a structure of a developing sleeve.

FIG. 16 is a cross sectional view showing a structure of the developing sleeve. The developing sleeve 51 shown in FIG. 16 has a cylindrical shape and is made of a nonmagnetic material such as aluminum, brass, stainless steel and conductive resin. The developing sleeve 51 is driven by the driving shaft 511 which forms a rotary driving mechanism (not shown). The magnet group 512 exerts a magnetic force sufficient to attract the magnetic carriers onto the surface of the developing sleeve 51. The driving shaft 511 is provided at the center of the magnet group 512 and rotates the magnet group 512. The driving shaft 511 is supported by bearings 514 and 515 disposed on end parts of the developing sleeve 51, and is rotatable independently of the developing sleeve 51 so as to enable adjustment of the main pole direction.

Figure 17:
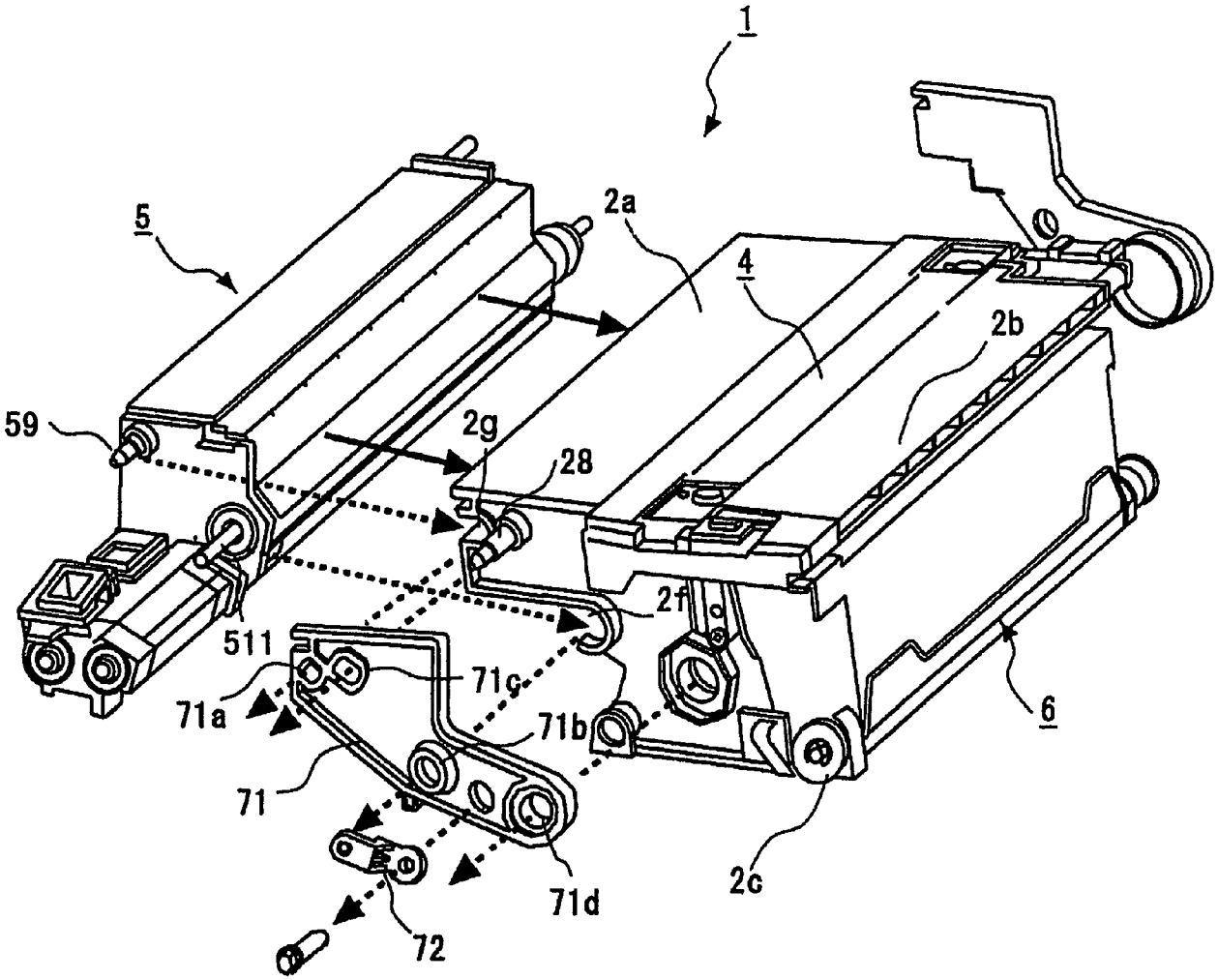
FIG. 17 is a perspective view generally showing a state where the developing module is loaded.
Figure 18:
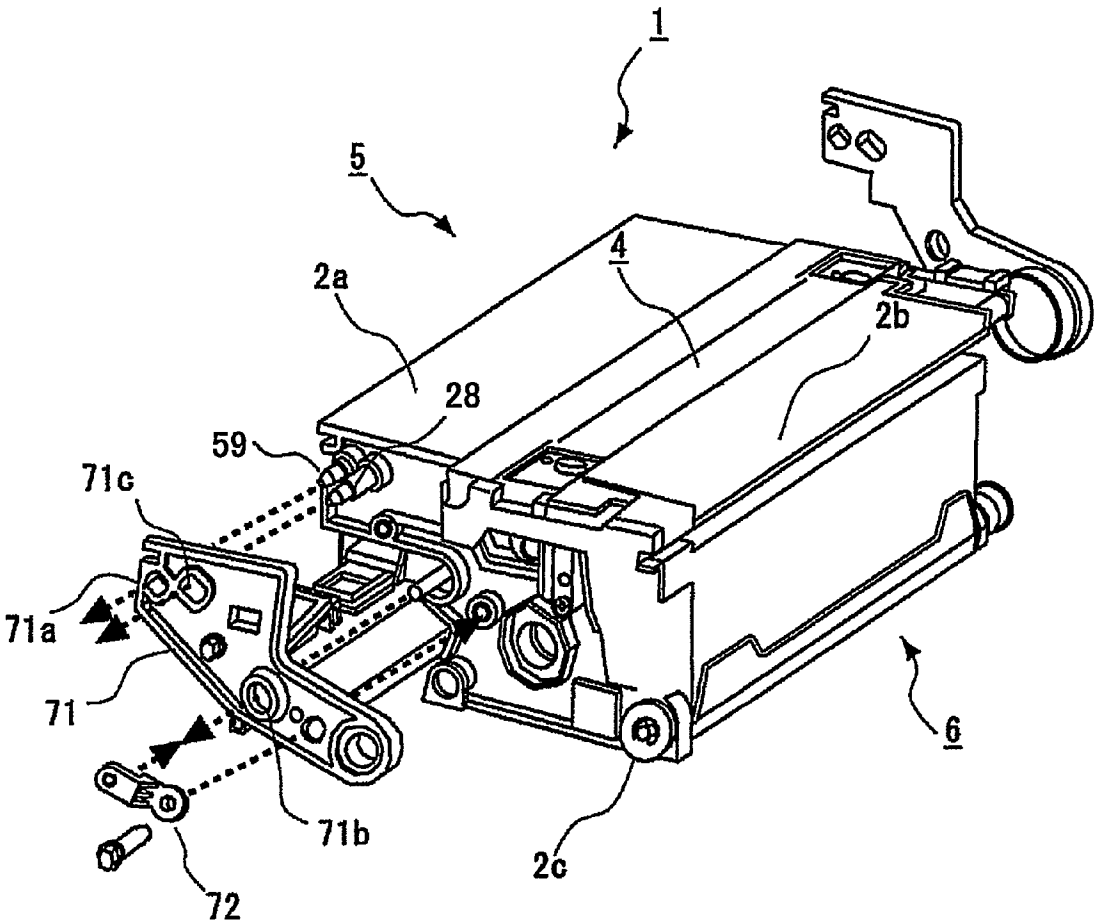
FIG. 18 is a perspective view generally showing a state where the developing module is loaded.

FIG. 17 is a perspective view generally showing a state where the developing module is loaded, and FIG. 18 is a perspective view generally showing a state where the developing module is loaded.

The developing module 5 is loaded into the first frame body 2*a* and positioned by positioning members 71 and angular positioning members 72 which respectively form developing position determining members. As shown in FIGS. 17 and 18, when loading the developing module 5 into the first frame body 2*a*, the projecting guides 59 of the developing module 5 are fitted into guide grooves 2*g* provided in the first frame body 2*a*, the projecting guides 59 are inserted into hole parts 71*a* of the positioning member 71, projecting guides 28 formed on the first frame body 2*a* are inserted into hole parts 71*c* of the positioning members 71, and the driving shaft 511 is inserted into hole parts 71*b* of the positioning members 71, so as to support the developing sleeve 51 in a rotational state where the outer peripheral surface of the developing sleeve 51 is positioned with respect to the surface of the photoconductive body 3.

Figure 19:
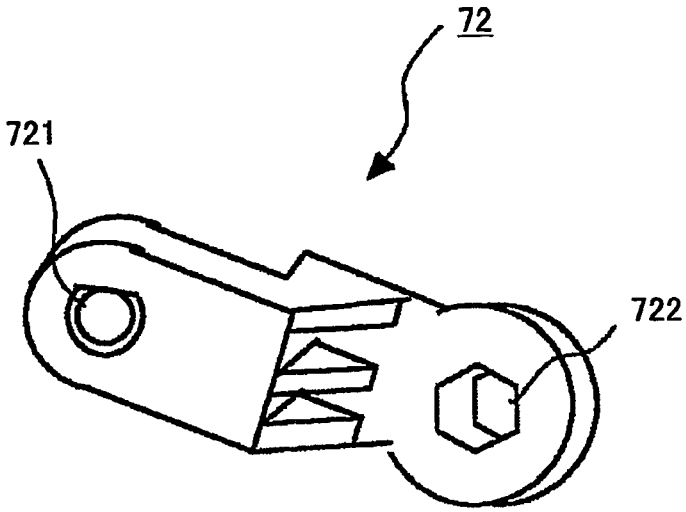
FIG. 19 is a perspective view showing a general structure of an angular position determining member.

FIG. 19 is a perspective view showing a general structure of the angular position determining member. Each end part of the driving shaft 511 penetrates the hole part 71*b* of the positioning member 71 and fits into a D-shaped hole (or bearing) 721 in the angular positioning member 72 shown in FIG. 19. Since the end part of the driving shaft 511 has the D-shaped cross section, the driving shaft 511 is positioned to a predetermined angular position (or rotary position) and is prevented from rotating by engaging the D-shaped hole 721. Of course, the end part of the driving shaft 511 is not limited to the D-shaped cross section, and the hole 721 is not limited to the D-shape, as long as it is possible to prevent the driving shaft 511 from rotating and to position the driving shaft 511 to the predetermined angular position. The main pole direction of the magnet group 512 with respect to the photoconductive body 3 can be adjusted by the angular positioning member 72. Further, by fixing the angular positioning member 72 on the positioning member 71 by a screw which penetrates a fixing hole 722 in the angular positioning member 72, it becomes possible to fix the main pole direction at the adjusted position.

In addition, the driving shaft 101 of the photoconductive body 3 of the image forming apparatus 100 penetrates holes 71*d* in the positioning members 71. As a result, it is possible to position the photoconductive body 3 and the developing module 5 relative to each other. Hence, the positioning members 71 can be used as a main reference for the positioning of the photoconductive body 3 and the developing sleeve 51, and a gap (or developing gap) between the developing sleeve 51 and the photoconductive body 3 may be adjusted based on this main reference.

Therefore, the developing module 5 can simply be positioned with a high accuracy with respect to the process cartridge 1, by determining the angular position of the magnet group 512 with respect to the photoconductive body 3 and determining the position of the developing sleeve 51 with respect to the photoconductive body 3. Particularly in the case of the replaceable developing module 5, the gap between the photoconductive body 3 and the developing sleeve 51 greatly affects the image quality of the image that is formed, and it is important to accurately maintain this gap even after the developing module 5 is replaced by another developing module 5. Because the main pole direction is determined by the angular positioning member 72 after determining the developing gap by positioning the developing sleeve 51 and the photoconductive body 3 by the positioning members 71, the developing module 5 can be positioned with a high accuracy with respect to the photoconductive body 3. In this embodiment, this accurate positioning can be maintained by the provision of the D-shaped hole (or bearing) 721 in the angular positioning member 72.

The projecting guide 59 of the developing module 5 fits into the guide part 2*g* of the first frame body 2*a*, and the driving shaft 511 fits into the guide part 2*f* of the first frame body 2*a*, on each side of the process cartridge frame body 2. At the same time, the projecting guide 59 of the developing module 5 and the projecting guide 28 of the first frame body 2*a* fit into the respective hole parts 71*a* and 71*c* of the positioning member 71, while the driving shaft 511 fits into the hole part 71*b* of the positioning member 71. Thus, the projecting guide 59 of the developing module 5 forms a part that is to be positioned with respect to the positioning reference, and the projecting guide 28 of the first frame body 2*a* forms a part that is to be positioned with respect to the positioning reference, so that a stable rotation of the magnet group 512 and the like can be realized within the developing module 5. The projecting guides 59 and 28 may have a D-shaped cross section, and the corresponding hole parts 71*a* and 71*c* in the positioning member 71 may have a D-shape, so that the developing module 5 and the process cartridge frame body 2 can be positioned with a high accuracy relative to each other.

The developing module 5 can easily be separated from the process cartridge frame body 2 by removing the angular positioning members 72 and the positioning members 71 in a reverse order to that described above.

In this embodiment, the developing module 5 employs the dry type two-component developing agent. However, the developing module 5 is not limited to such, and recycled toner may be used for the dry type developing agent. In addition, the developing module 5 may use a single-component magnetic developing agent or a single-component nonmagnetic developing agent.

The developing module 5 may be provided with the supply opening 58 for supplying the toner, as in the case of this embodiment. The process cartridge 1 is shipped in a state where the supply opening 58 is sealed by a seal, a lid or the like, and the supply opening 58 is first opened when using the process cartridge 1. After the supply opening 58 is opened and the toner within the process cartridge 1 is used, the toner may be supplied to the process cartridge 1 via the supply opening 58 when the amount of toner within the process cartridge 1 becomes low, so as to enable the process cartridge 1 to be used again. The process cartridge 1 may accommodate the newly supplied toner within the developing agent accommodating part 53. The toner that is supplied may be newly supplied or, may be recovered toner for reuse. An accommodating part (not shown) for accommodating the toner that is to be supplied may be provided in the main body of the image forming apparatus 100. In addition, such an accommodating part may be provided within the process cartridge 1. In such cases, the developing module 5 can be used repeatedly without having to replace the developing module 5, by supplying the toner to the developing module 5 when necessary.

Figure 20:
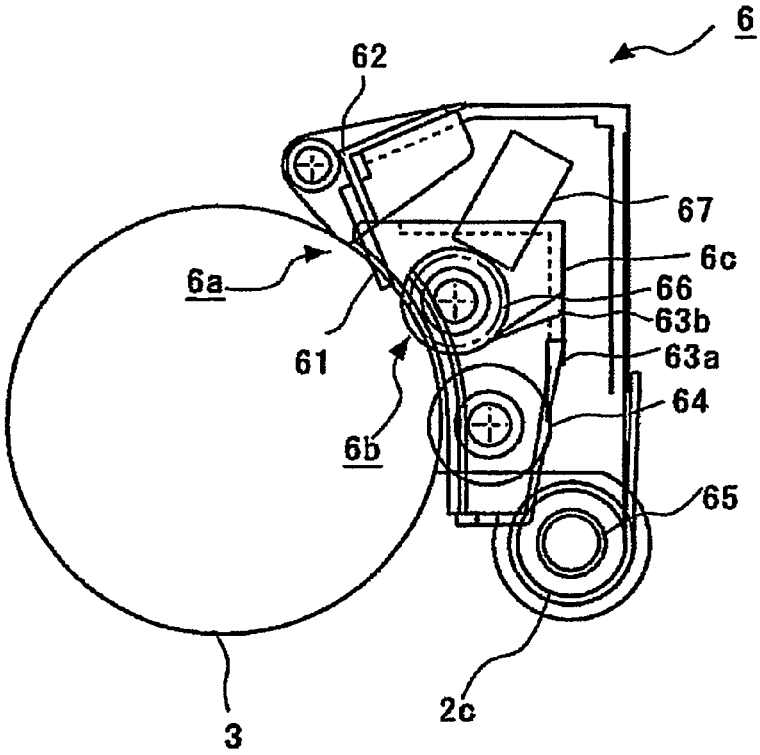
FIG. 20 is a cross sectional view showing a general structure of a cleaning module.

FIG. 20 is a cross sectional view showing a general structure of the cleaning module. As shown in FIG. 20, the cleaning module 6 is made up of a cleaning mechanism 6*a* and a coating mechanism 6*b*. The cleaning mechanism 6*a* cleans the photoconductive body 3. The cleaning mechanism 6*a* includes a cleaning blade 61 for removing the residual toner on the surface of the photoconductive body 3, a support member 62 which urges the cleaning blade 61 against the photoconductive body 3, a bias roller 64 for controlling the amount of charge of the residual toner, a recovery roller 66 for recovering the toner adhered on the cleaning blade 61, a flicker 63*a* for removing the residual toner adhered on the bias roller 64, and a flicker 63*b* for removing the residual toner adhered on the recovery roller 66. The residual toner cleaned by the cleaning blade 61 and the residual toner removed by the flickers 63*a* and 63*b* fall downwards due to its own weight, and is transported outside the process cartridge 1 by a transport auger 65 which is formed coaxially to the rotary axis or the engaging part 2*c* of the process cartridge frame body 2, so as to be recovered within a waste toner accommodating part (not shown).

The coating mechanism 6*b* includes a lubricant body 67, and a coating roller 66 which contacts the lubricant body 67 and wipes the lubricant from the lubricant body 67 to supply the lubricant on the surface of the photoconductive body 3. In this embodiment, the recovery roller 66 also functions as the coating roller 66, and thus, the roller 66 will hereinafter be referred to as a recovery and coating roller 66. A pressing spring (not shown) may be provided to push the lubricant body 67 against the recovery and coating roller 66 with a predetermined pushing force or pressure. In this case, the lubricant body 67 may have a rectangular parallelepiped shape and held in the cleaning module 6 in a state where the lubricant body 67 contacts the recovery and coating roller 66 with the predetermined pressure applied from the pressing spring. Thus, the recovery and coating roller 66 simultaneously recovers the residual toner adhered on the cleaning blade 61 and coats the lubricant on the surface of the photoconductive body 3.

The coating mechanism 6*b* is provided within the cleaning module 6 shown in FIG. 20, but the coating mechanism 6*b* may be formed as a replaceable module that is separate from the cleaning mechanism 6*a*. In this case, the module of the coating mechanism 6*b* can be replaced independently of the cleaning mechanism 6*a*.

The recovery and coating roller 66 has a shape extending along the axial direction of the photoconductive body 3. The pressing spring constantly pushes the lubricant body 67 against the recovery and coating roller 66, so that it is possible to use substantially all of the lubricant body 67 for the lubricant coating. Since the lubricant body 67 is a consumable supply, the thickness of the lubricant body 67 decreases with time, that is, with use. However, the lubricant can be wiped to be supplied and coated on the photoconductive body 3 in a stable manner, by constantly pushing the lubricant body 67 against the recovery and coating roller 66 by the action of the pressing spring.

The lubricant forming the lubricant body 67 may be fatty metal oxide salts such as lead oleic acid, zinc oleic acid, copper oleic acid, zinc stearate, cobalt stearate, iron stearate, copper stearate, zinc palmitic acid, copper palmitic acid and zinc linolenic acid. The lubricant may also be fluorine-based resins such as polytetrafluoroethylene, polychlorotrifluoroethylene, polyfluoridevinylidene, polytrifluorochlorethylene, dichlorodifluoroethylene, tetrafluoroethylene-ethylene copolymer and tetrafluoroethylene-oxafluoropolypyrene copolymer. From the point of view of the large effect of reducing the friction of the photoconductive body 3, the lubricant is preferably metal oxide salt stearate, and more preferably zinc stearate.

Figure 21:
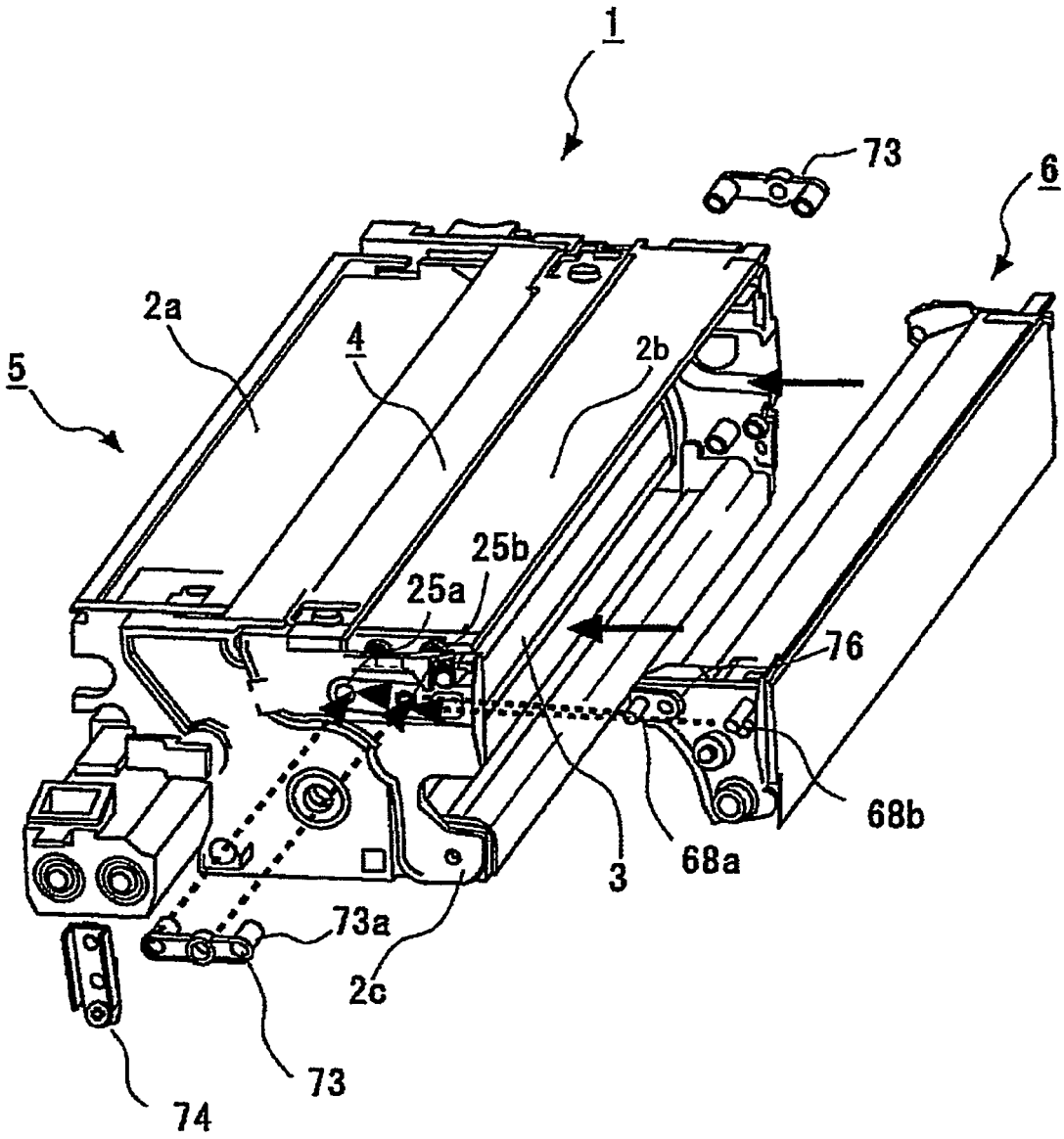
FIG. 21 is a perspective view generally showing a state where the cleaning module is loaded.

FIG. 21 is a perspective view generally showing a state where the cleaning module is loaded. The cleaning module 6 shown in FIG. 21 is loadable and removable (or unloadable) with respect to the process cartridge 1, independently of other process means or units, in a horizontal (or lateral) direction of the process cartridge 1. When connecting the cleaning module 6 to the process cartridge 1, first and second projecting guides 68*a* and 68*b* of the cleaning module 6 are fitted into corresponding first and second hole parts 25*a* and 25*b* in the second frame body 2*b*, and the first and second projecting guides 68*a* and 68*b* are fixed by cleaning position determining members 73 having cylindrical guides 73*a* for receiving the first and second projecting guides 68*a* and 68*b*. The contacting conditions of the cleaning blade 61 and the like with respect to the photoconductive body 3 are adjusted when fixing the cleaning module 6 to the second frame body 2*b* by the cleaning position determining members 73. It is also possible to insert the transport auger 65 into the engaging parts 2*c* of the second frame body 2*b* when securing the cleaning module 6 to the process cartridge 1.

Figure 22:
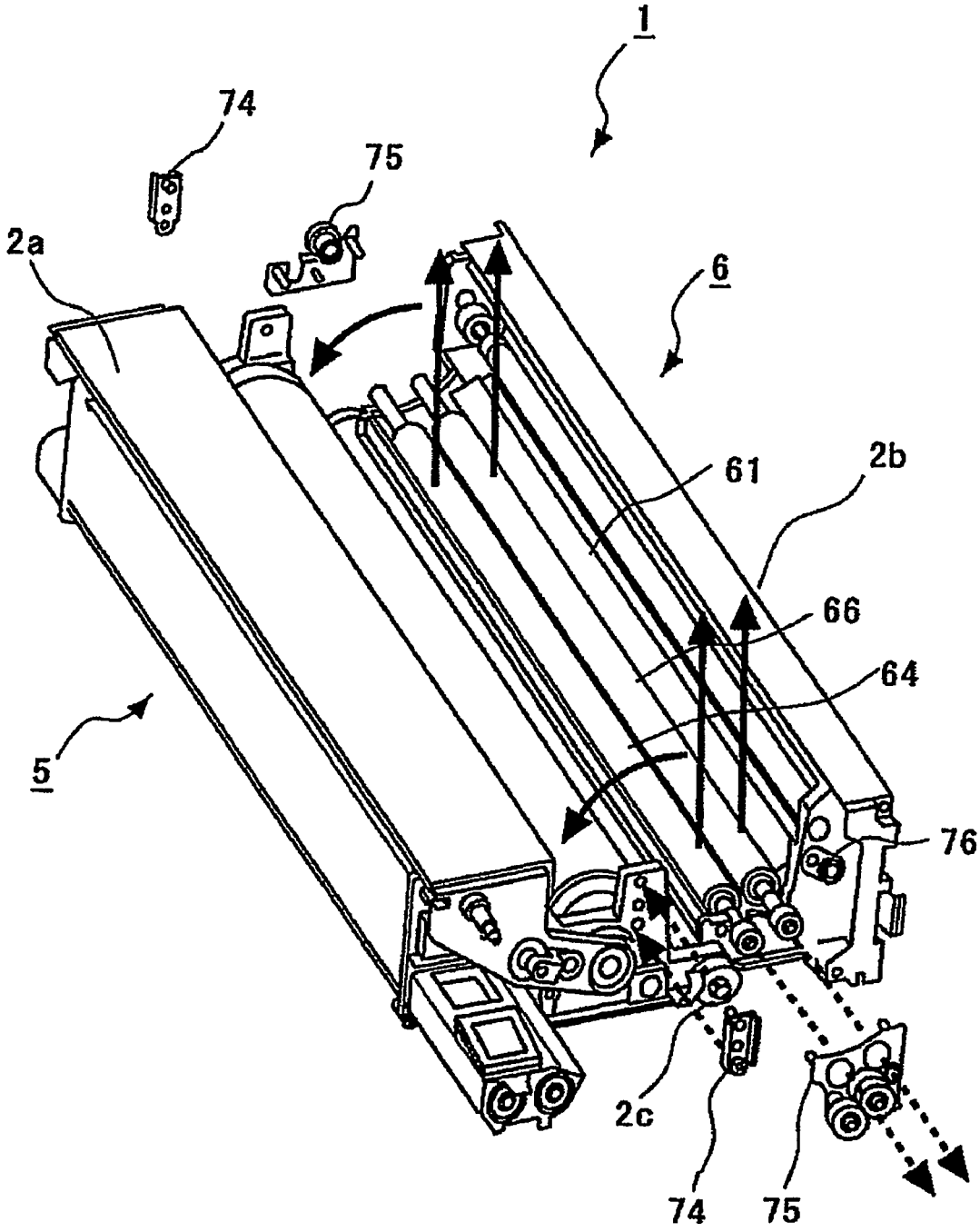
FIG. 22 is a perspective view generally showing a state where another cleaning module is loaded into a second frame body.

FIG. 22 is a perspective view generally showing a state where another cleaning module is loaded into the second frame body. In FIG. 22, the cleaning module 6 is made up of a cleaning submodule 6*c* which includes the coating roller 66 and the like, and a cleaning submodule 6*d* which includes the cleaning blade 61 and the like. As shown in FIG. 22, the cleaning submodules 6*c* and 6*d* are replaceable via an open space that is formed when the second frame body 2*b* is pivoted relative to the first frame body 2*a*. By forming the cleaning module 6 from such cleaning submodules 6*c* and 6*d*, it is possible to design each submodule to be made up of parts having similar serviceable lives. For example, the cleaning blade 61, the support member 62 and the like having relatively long serviceable lives may be provided in the cleaning submodule 6*d*, and the coating roller 66 and the like having shorter serviceable lives may be provided in the cleaning submodule 6*c*, so that it is possible to replace the parts of the cleaning module 6 in units of submodules each made up of parts having similar serviceable lives. Consequently, it is possible to use each part of the cleaning module 6 until approximately the end of its serviceable life to prevent usable parts from being wasted, which is not possible when the entire cleaning module 6 is replaced.

Figure 23:
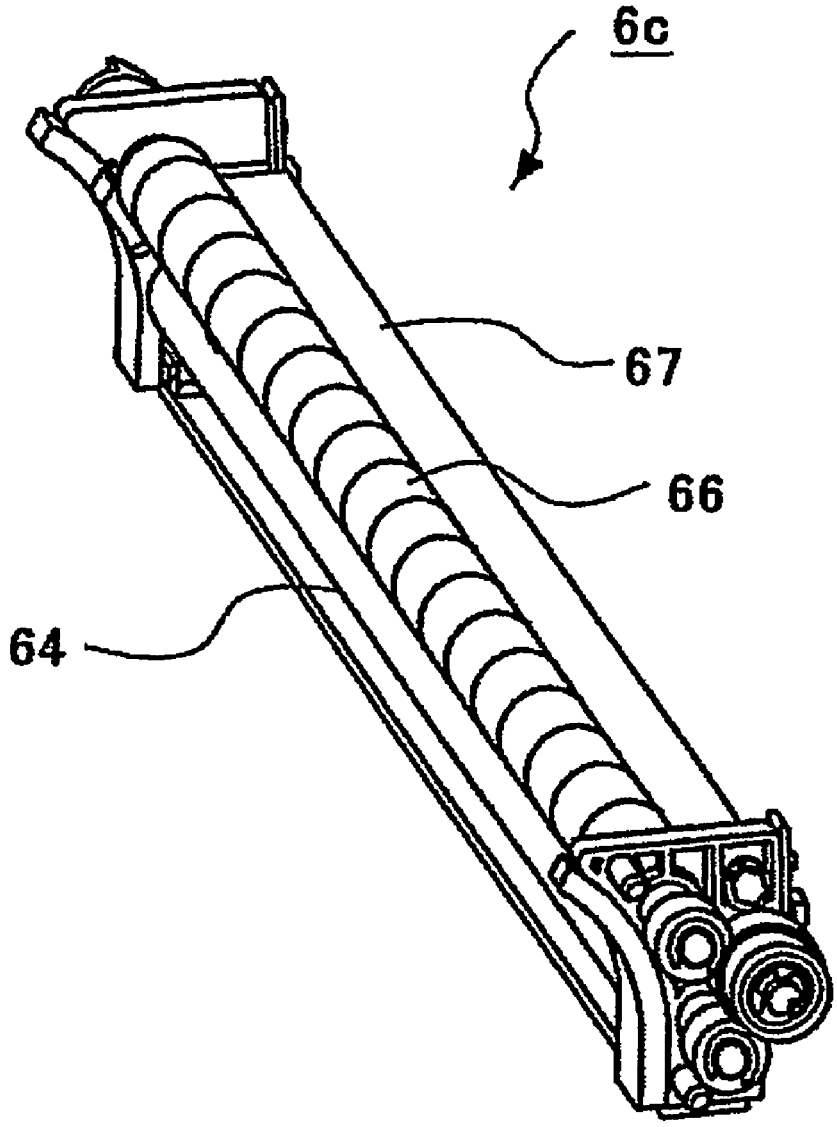
FIG. 23 is a perspective view showing a general structure of a cleaning submodule within the cleaning module.

FIG. 23 is a perspective view showing a general structure of the cleaning submodule within the cleaning module. The cleaning submodule 6*c* includes the bias roller 64, the recovery and coating roller 66 and the like which rotate and easily wear out. Hence, the bias roller 64, the recovery and coating roller 66 and the like may be replaced simultaneously in units of this submodule 6*c*. Parts having relatively short replacement intervals, such as the flicker 63*a* for removing the residual toner adhered on the bias roller 64 and the flicker 63*b* for removing the residual toner adhered on the recovery (and coating) roller 66, may also be included in the cleaning submodule 6*c* in addition to the bias roller 64 for controlling the amount of charge of the residual toner and the recovery and coating roller 66 for coating and recovering the lubricant.

On the other hand, the cleaning blade 64, the support member 62 and the like may be replaced simultaneously in units of the cleaning submodule 6*d*. The parts included in the cleaning submodule 6*d* have longer replacement intervals than the parts included in the cleaning submodule 6*c*, and may be relatively expensive compared to the parts included in the cleaning submodule 6*c*.

Figure 24:
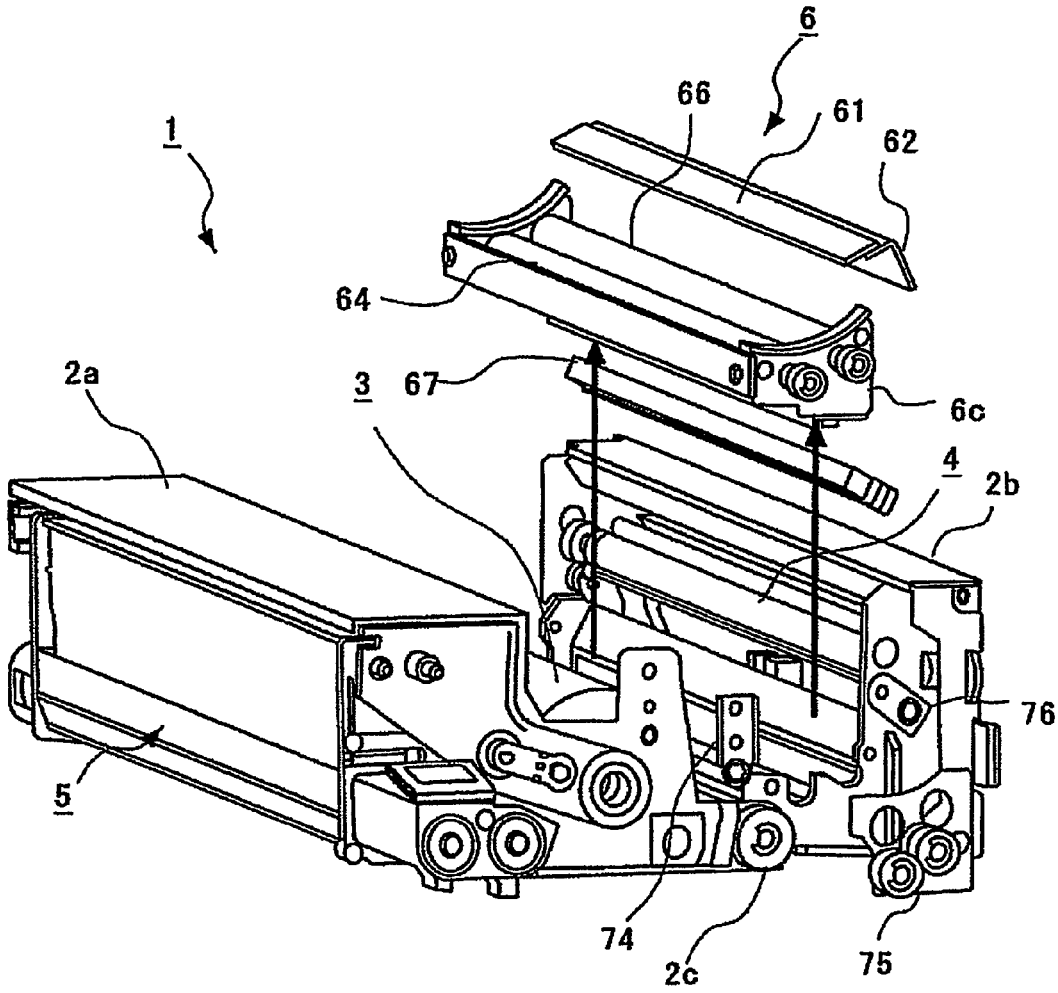
FIG. 24 is a perspective view generally showing a state where the second frame body is turned to form an open space and the cleaning submodules are removed from the open space.

FIG. 24 is a perspective view generally showing a state where the second frame body is turned to form an open space and the cleaning submodules re removed via the open space. In the state shown in FIG. 24, the second frame body 2*b* is turned relative to the first frame body 2*a* to form an open space, and the cleaning submodules 6*c* and 6*d* are removed via this open space. The cleaning submodule 6*c* is fixed on the second frame body 2*b* by cleaning position determining members 75 each having 2 pins, and the bias roller 64 and the recovery and coating roller 66 are positioned to suitable contacting states on the photoconductive body 3. The cleaning submodule 6*d* is fixed on the second frame body 2*b* by blade positioning member 76, so that the cleaning blade 61 is positioned to a suitable contacting state on the photoconductive body 3. In this case, the lubricant body 67 is inserted into a hole part formed in the second frame body 2*b*, and the lubricant body 67 is replaced after removing the cleaning submodule 6*c*.

The cleaning submodule 6*c* and/or the cleaning submodule 6*d* are/is replaced in a state where the second frame body 2*b* is turned approximately 90 degrees with respect to the first frame body 2*a* and opened. By turning the second frame body 2*b*, the cleaning submodules 6*c* and 6*d* can be replaced in a state where the residual toner removed from the photoconductive body 3 is held within the second frame body 2*b*, and the scattering of the residual toner is effectively suppressed.

According to the process cartridge 1, each of the photoconductive body 3, the charging module 4, the developing module 5 and the cleaning module 6 (or the cleaning submodules 6*c* and 6*d*) can be removed and replaced independently. Further, each of the replaced photoconductive body 3, charging module 4, developing module 5 and cleaning module 6 (or cleaning submodules 6*c* and 6*d*) can accurately be positioned with respect to the process cartridge 1.

In addition, the positioning member 71 and the angular positioning member 72 for positioning the developing module 5, and the frame body positioning member 74 for positioning the photoconductive body 3 do not overlap on the process cartridge frame body 2. For this reason, the positioning members 71 and 72 can be replaced independently of the positioning member 74, thereby making it possible to replace the developing module 5 and the photoconductive body 3 independently of each other.

Moreover, the positioning member 71 and the angular positioning member 72 for positioning the developing module 5, and the cleaning position determining member 73 for positioning the cleaning module 6 do not overlap on the process cartridge frame body 2. For this reason, the positioning members 71 and 72 can be replaced independently of the cleaning position determining member 73, thereby making it possible to replace the developing module 5 and the cleaning module 6 independently of each other.

Furthermore, in a state where the frame body positioning member 74 is removed and the second frame body 2*b* is turned approximately 90 degrees relative to the first frame body 2*a*, the positioning member 71 and the angular positioning member 72 for positioning the developing module 5, and the cleaning position determining member 75 and the blade positioning member 76 for positioning the cleaning submodules 6*c* and 6*d* do not overlap on the process cartridge frame body 2. For this reason, the positioning members 71 and 72 can be replaced independently of the position determining members 75 and 76, thereby making it possible to replace the developing module 5 and the cleaning submodules 6*c* and 6*d* independently of each other.

Each of the positioning member 71 and the angular positioning member 72 for positioning the developing module 5, the fitting parts 15*f* and 15*r* for positioning the charging module 4 on the process cartridge frame body 2, and the cleaning position determining member 75 for positioning the cleaning module 6 (or the cleaning position determining member 75 and the blade positioning member 76 for positioning the cleaning submodules 6*c* and 6*d*) does not overlap with another positioning or position determining member associated with another module. For this reason, the positioning or position determining member and its associated module can be removed and loaded (that is, replaced) independently of other positioning or position determining member and its associated module.

In other words, the charging module 4 can be removed by pulling the charging module 4 upwards from the fitting part 15 of the process cartridge 1. The developing module 5 can be removed from the process module frame body 2 by removing the angular positioning member 72 and further the positioning member 71, as may be seen from FIGS. 17 and 18. The cleaning module 6 may be removed in the horizontal direction by removing the cleaning position determining member 73. In the case where the cleaning module 6 is made up of the cleaning submodules 6*c* and 6*d* and in a state where the frame body positioning member 74 is removed and the second frame body 2*b* is turned and opened, the cleaning submodule 6*c* can be removed by removing the cleaning position determining member 75, and the cleaning submodule 6*d* can be removed by removing the blade positioning member 76.

Figure 25:
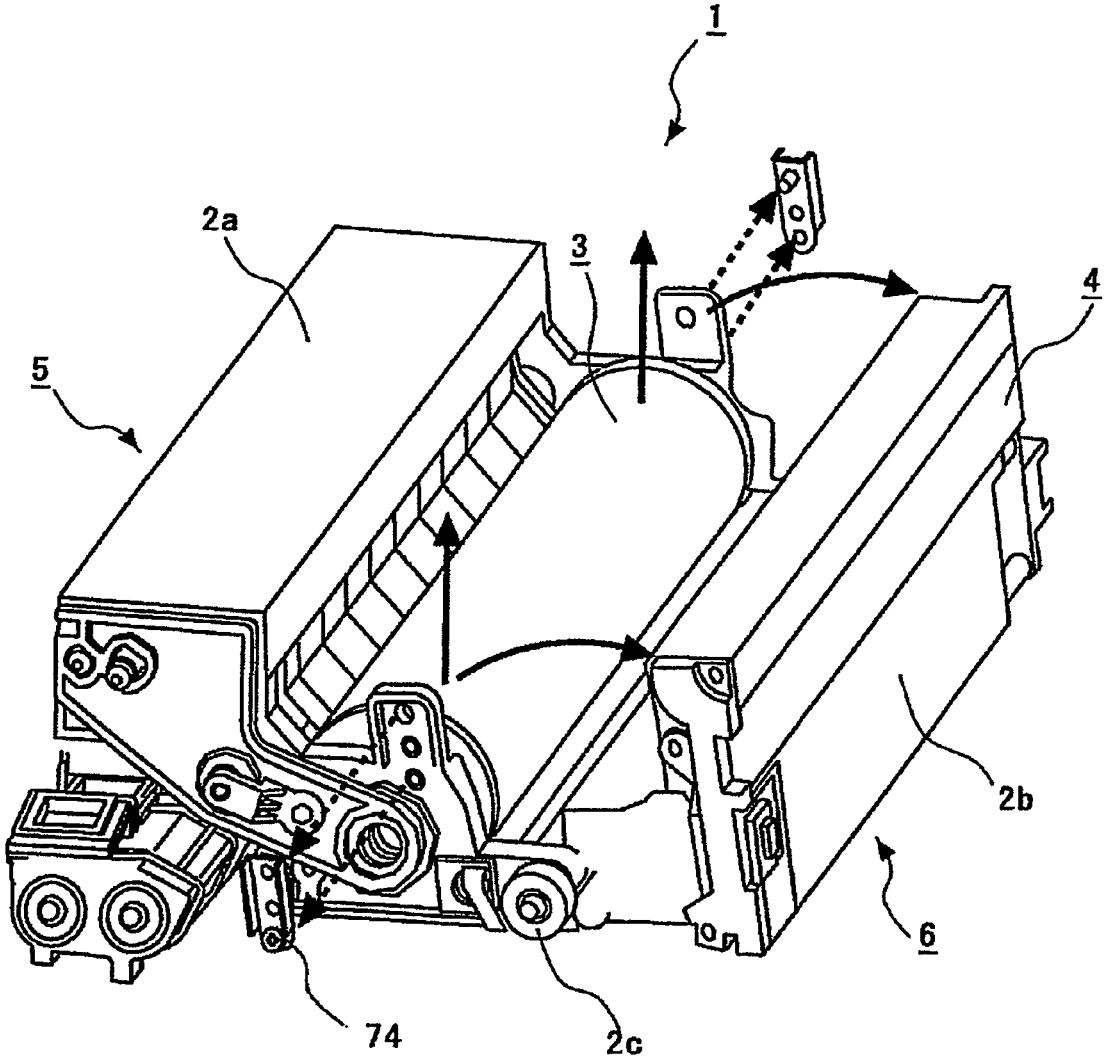
FIG. 25 is a perspective view generally showing a state where the photoconductive body is being removed and separated from the process cartridge.
Figure 26:
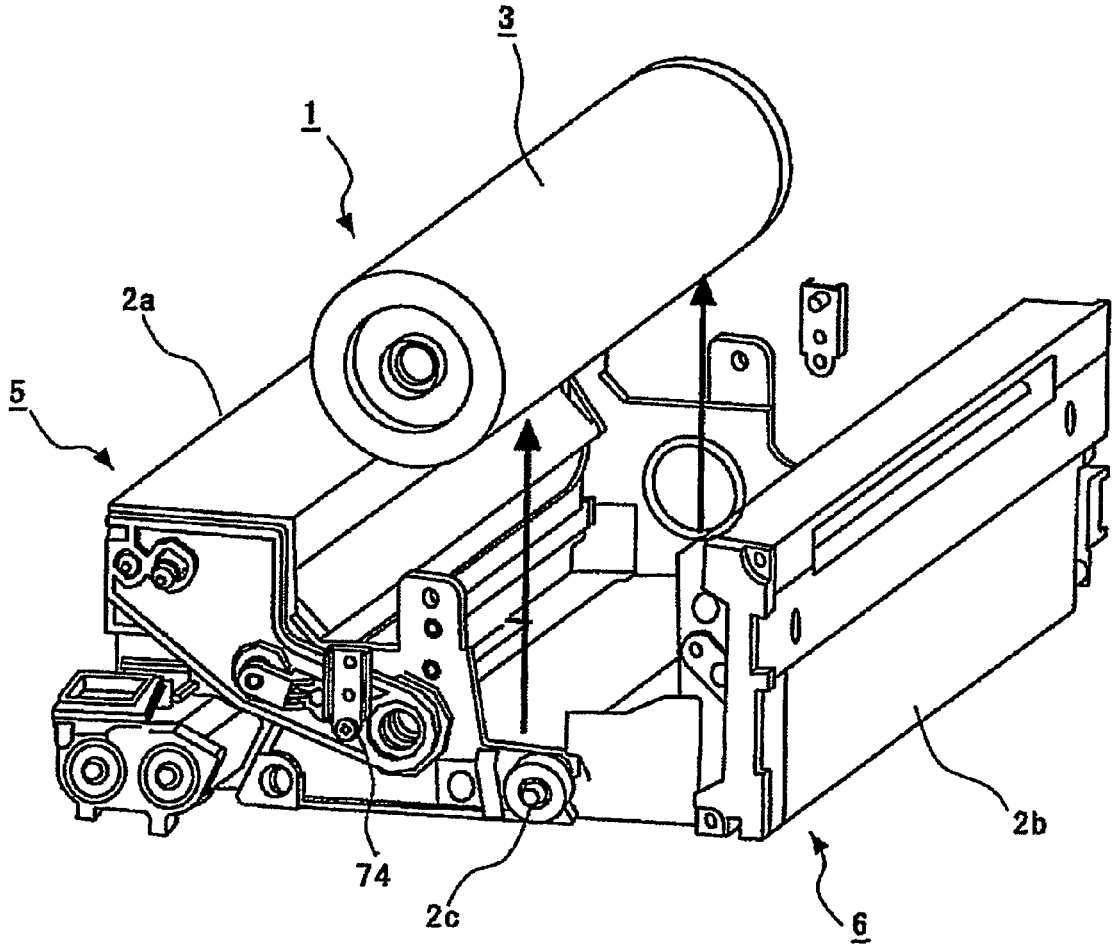
FIG. 26 is a perspective view generally showing a state where the photoconductive body is removed and separated from the process cartridge.

FIG. 25 is a perspective view generally showing a state where the photoconductive body is being removed and separated from the process cartridge, and FIG. 26 is a perspective view generally showing a state where the photoconductive body is removed and separated from the process cartridge. The photoconductive body 3 can be removed as shown in FIGS. 25 and 26. That is, the positioning member 74 fixing the second frame body 2*b* is removed, and the second frame body 2*b* is turned about the engaging part 2*c* to form an open space above the process cartridge 1, as shown in FIG. 25. In this state, the photoconductive body 3 is merely supported by the support part 13 of the process cartridge frame body 2 and is not fixed to the process cartridge 1. Hence, the photoconductive body 3 can easily be removed by pulling the photoconductive body 3 upwards as shown in FIG. 26 while pushing the photoconductive body 3 against the frame body positioning member 74.

Figure 27:
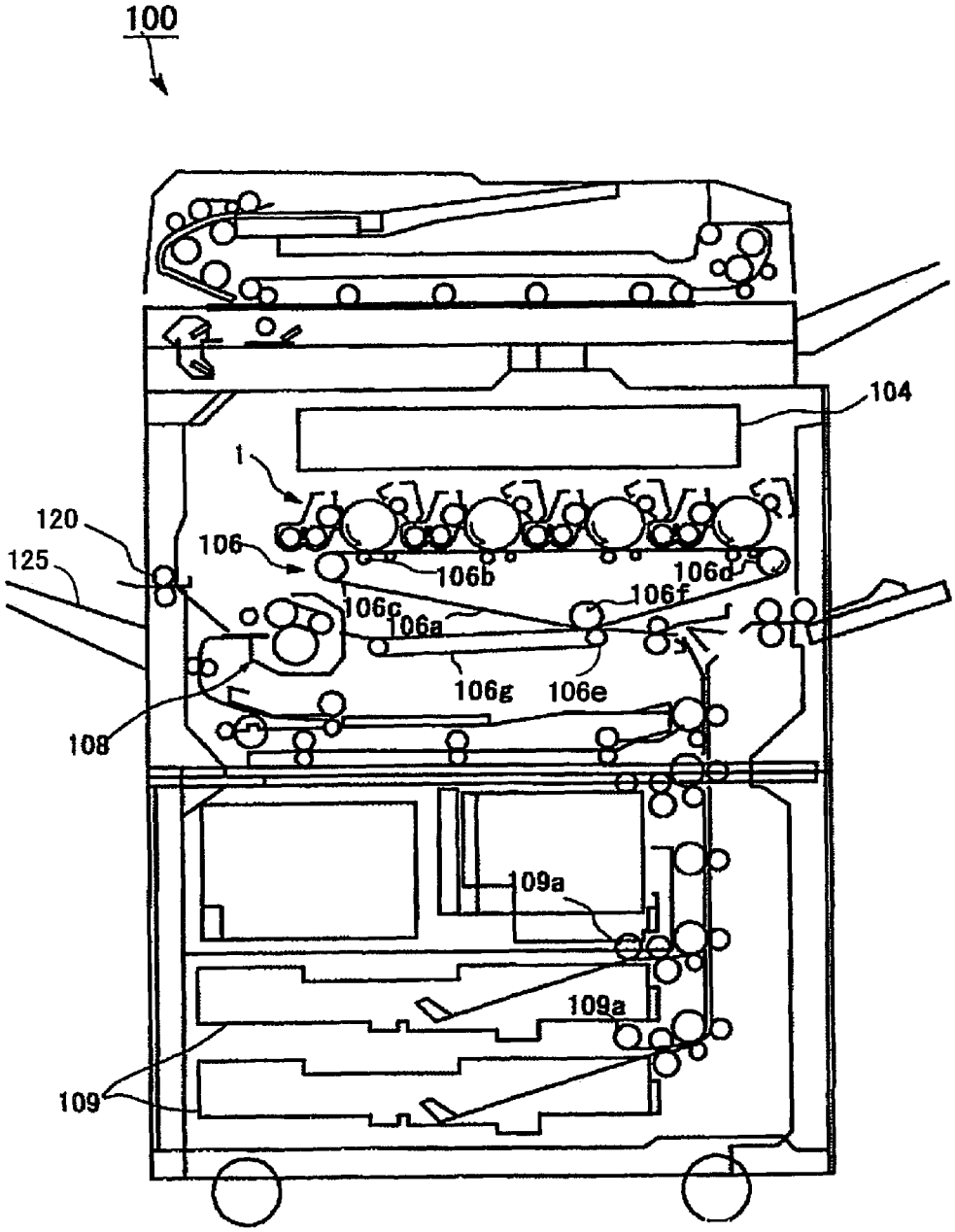
FIG. 27 is a diagram showing a general structure of an embodiment of an image forming apparatus according to the present invention.

FIG. 27 is a diagram showing a general structure of an embodiment of an image forming apparatus according to the present invention. In this embodiment, the present invention is applied to the image forming apparatus 100 which employs the electrophotography technique to form a full color image. The image forming apparatus 100 is a tandem type having 4 process cartridges 1 arranged in a transport direction of a recording medium such as paper. An endless intermediate transfer belt 106*a* of a transfer unit 106 is provided around 3 support rollers 106*c*, 106*d* and 106*f*. Yellow, cyan, magenta and black toner images are formed by the 4 process cartridges 1 and transferred onto the intermediate transfer belt 106*a* in an overlapping manner by electrostatic transfer provided by transfer rollers 106*b* confronting the photoconductive bodies 3 of the 4 process cartridges 1 via the intermediate transfer belt 106*a*. The transfer region is formed by each photoconductive body 3 and the corresponding portion of the intermediate transfer belt 106*a* pressed by the transfer roller 106*b*. The recording medium is transported by a transport belt 106*g*, and a positive polarity bias is applied to a transfer roller 106*e*when transferring the toner images on the intermediate transfer belt 106*a* onto the recording medium transported on the transport belt 106*g*. As a result, the toner image formed by the photoconductive body 3 of each process cartridge 1 is successively and electrostatically transferred from the intermediate transfer belt 106*a* onto the recording medium, and fixed by a fixing unit 108. Of course, a belt cleaning unit may be provided in a periphery of the intermediate transfer belt 106*a* to remove the residual toner on the surface of the intermediate transfer belt 106*a*. An exposure unit 104 forms a latent image on the photoconductive body 3, as will be described later.

Medium supply cassettes 109 accommodate the recording media, and each recording medium is fed by a resist roller pair 109*a* and transported by the transport belt 106*g*. In this embodiment, the overlapping toner images formed on the recording medium is fixed by heat and pressure applied by the fixing unit 108, and is ejected outside the image forming apparatus 100 onto an eject tray 125 via eject rollers 120.

In the image forming apparatus 100, it is preferable to use a toner having an average circularity of 0.93 or greater. In the case of the toner that is manufactured by dry grinding, the circularity can be adjusted by a thermal or mechanical process which shapes the toner particles (or grains) into approximately spherical shapes. When carrying out the thermal process to shape the toner particles, the toner particles may be sprayed to an atomizer or the like together with hot air. On the other hand, when carrying out the mechanical process to shape the toner particles, the toner particles may be supplied to a mixer, such as a ball mill, together with a mixture medium having a low specific gravity such as glass and agitated. A classification process may be carried out since large toner particles are generated by the thermal process and fine toner particles are generated by the mechanical process. In the case of the toner that is manufactured within an aqueous solution, the shape of the toner particles can be controlled by strongly agitating the toner particles during the process of removing the solution.

A circularity SR may be defined as SR=[(periphery of circle having the same area as a particle projection area)/(periphery of particle projection image)×100]%, and the toner particle becomes closer to a true sphere as the circularity SR becomes closer to 100%, where the periphery of indicates the peripheral length. The toner particles having a high circularity SR are easily affected by the electric line of force on the carrier or the developing sleeve 51, and are faithfully developed along the electric line of force of the electrostatic latent image. When reproducing fine latent image dots, it is easier to obtain a precise and uniform toner arrangement, thereby making it possible to obtain a high reproducibility of thin lines. In addition, because the toner particles having the high circularity SR have a smooth surface and suitable fluidity (or flowability), these toner particles are easily affected by the electric line of force and faithfully move along the electric line of force, and a transfer efficiency (or transferring rate) becomes high to enable a high-quality image to be formed. Even in a case where the intermediate transfer belt 106*a* pushes against the photoconductive body 3, the toner particles having the high circularity SR uniformly contact the intermediate transfer belt 106*a*, and a uniform contact area contributes to the improvement of the transfer efficiency. However, when the average circularity of the toner particles is less than 0.93, a faithful development and a transfer with a high transfer efficiency cannot be achieved. This is because the charge on the toner surface is non-uniform in the case of the toner particles having undefined shapes, and it is difficult for the toner particles to move faithfully with respect to the electric field due to the center of gravity and the center of the charging which do not match.

Next, a description will be given of the image forming operation of the image processing apparatus 100, for one process cartridge 1. When the image forming operation starts, the charging module 4 first uniformly charges the photoconductive body 3 to a negative polarity. Then, the exposure unit 104 scans the surface of the photoconductive body 3 by a laser beam based on image data related to the image that is to be formed, so as to form a latent image on the photoconductive body 3. The developing module 5 visualizes the latent image into a toner image. In this state, the photoconductive body 3 bearing the toner image rotates and enters the transfer region, and with respect to the intermediate transfer belt 106 which moves in synchronism wit the rotation of the photoconductive body 3, the bias applied from the transfer roller 106*b* causes the toner image to be transferred onto the intermediate transfer belt 106 in the transfer region. In the transfer region, the developed toner image on the photoconductive body 3 is affected by the transfer electric field and the nip pressure.

In the case of the tandem type image forming apparatus 100 which uses the 4 process cartridges 1 accommodating toners of mutually different colors, the toner images of different colors are formed on the photoconductive bodies 3 of the 4 process cartridges 1 and successively transferred onto the intermediate transfer belt 106*a* in an overlapping manner, so as to form a full-color toner image. When the recording medium from the medium supply cassette 109 is fed by the resist roller pair 109*a* towards the supply roller 106*f*, the recording medium reaches a secondary transfer region in synchronism with the movement of the intermediate transfer belt 106*a*. In the secondary transfer region, the bias applied from the transfer roller 106*e*causes the full-color toner image to be transferred from the intermediate transfer belt 106*a* onto the recording medium. The full-color toner image on the recording medium is melted and fixed by the fixing unit 108, and is ejected onto the eject tray 125 by the eject rollers 120.

After the image is formed on the photoconductive body 3, the recovery and coating roller 66 of the coating mechanism 6*b* wipes the zinc stearate lubricant from the lubricant body 67, and coats this lubricant on the surface of the photoconductive body 3 by making sliding contact with the photoconductive body 3. Then, the cleaning blade 61 in contact with the photoconductive body 3 presses the lubricant so as to form a thin lubricant layer on the surface of the photoconductive body 3. By forming the thin lubricant layer, the residual toner on the photoconductive body 3 becomes more easily cleanable (or removable), and the residual toner can be removed even when the toner particles have a high circularity.

The thin lubricant layer formed on the surface of the photoconductive body 3 by the cleaning blade 61 of the cleaning module 6 reduces a coefficient of friction of the surface of the photoconductive body 6. The coefficient of friction, μ, of the surface of the photoconductive body 3 is preferably set to 0.4 or less. The coefficient of friction, μ, of the surface of the photoconductive body 3 may be controlling the setting conditions of the coating mechanism 6*b*, such as a pressure applied to the lubricant body 67 by the pressing spring, and the brush density, the brush diameter, the rotational speed and the rotating direction of the recovery and coating roller 66.

By setting the coefficient of friction, μ, of the surface of the photoconductive body 3 to 0.4 or less, it is possible to suppress the friction between the cleaning blade 61 and the photoconductive body 3 from becoming large, suppress deformation or turning of the cleaning blade 61, prevent the toner from slipping past the cleaning blade 61, and suppress the generation of poor cleaning. Furthermore, the above coefficient of friction, μ, is more preferably 0.3 or less. The coefficient of friction, μ, of the surface of the photoconductive body 3 is affected by other parts, modules or units provided within the image forming apparatus 100, and the value of the coefficient of friction, μ, changes from the value immediately after the image formation. However, for the image formation with respect to approximately 1,000 recording media, namely, A4-size recording paper, the value of the coefficient of friction, μ, remains substantially constant. Accordingly, the coefficient of friction, μ, in this embodiment refers to the coefficient of friction that becomes substantially constant in the steady state.

Since the thin line reproducibility is improved when a volume average particle size (diameter) Dv of the toner becomes smaller, the volume average particle size Dv of the toner used in this embodiment is 8 μm or less. But on the other hand, the developing characteristic and the cleaning characteristic deteriorate when the volume average particle size Dv is small, and it is preferable that the volume average particle size Dv is 3 μm or greater to prevent the developing and cleaning characteristic deterioration. When the volume average particle size Dv is less than 3 μm, the amount of fine toner particles which are uneasily developed tend to increase on the carrier or the surface of the developing sleeve 51, thereby causing the contact or friction of the other toner particles with the carrier or the developing sleeve 51 insufficient and the reverse charged toner particles to increase, to generate an abnormal image such as fogging.

A particle size distribution described by a ratio (Dv/Dn) of the volume average particle size Dv and a number average particle size Dn is preferably in a range of 1.05 to 1.40. By narrowing the particle size distribution, the charging distribution of the toner becomes uniform. When the ratio (Dv/Dn) exceeds 1.40, the charging distribution of the toner becomes wide and the reverse charged toner particles increase, thereby making it difficult to obtain a high-quality image. The toner having the ratio (Dv/Dn) that is less than 1.05 is not practical since it is difficult to manufacture such toner. The toner size can be measured by use of a Koltar counter multisizer (manufactured by Koltar), by selectively using 50 μm apertures for the measuring holes in correspondence with the toner size to the measured, and taking an average of 50,000 toner particles.

Figure 28A:
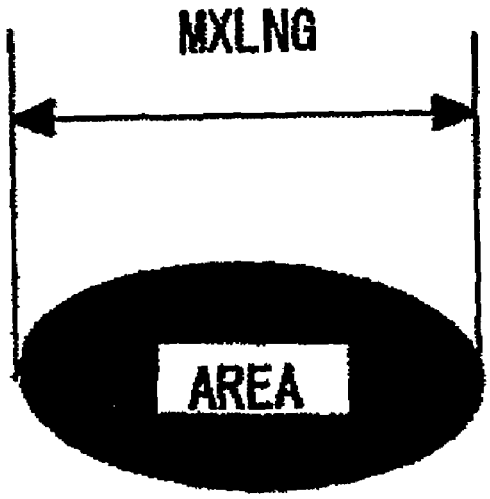
FIGS. 28A and 28B respectively are diagrams showing toner shapes for explaining a shape factor SF-1 and a shape factor SF-2.
Figure 28B:
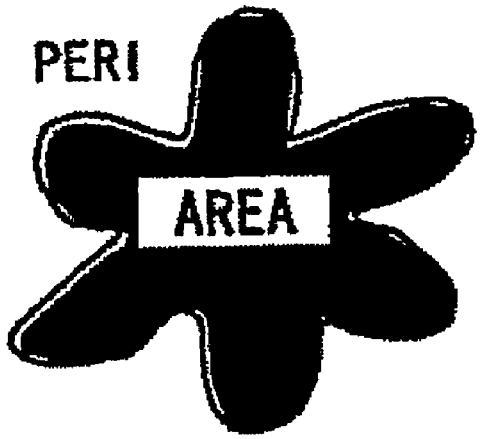

Of the circularity, it is preferable that the toner has a shape factor SF-1 in a range greater than or equal to 100 and less than or equal to 180 and a shape factor SF-2 in a range greater than or equal to 100 and less than or equal to 180. FIGS. 28A and 28B respectively are diagrams showing toner shapes for explaining the shape factor SF-1 and the shape factor SF-2. The shape factor SF-1 indicates a proportion of circularity of the toner particle and is represented by the following formula (1). A square of a maximum length MXLNG of the shape obtained by projecting the toner particle in a two-dimensional plane, is divided by a graphic area AREA and is then multiplied by 100Π/4 to obtain the value of the shape factor SF-1.

$$SF\text{-}1=\{(MXLNG)^2/\mathrm{AREA}\}\times(100\Pi/4) \quad (1)$$

When the value of SF-1 is equal to 100, the shape of the toner particle is perfectly circular, and as the value of SF-1 increases, the shape becomes more indefinite.

The shape factor SF-2 indicates a proportion of surface unevenness of the toner particle and is represented by the following formula (2). A square of a periphery PERI of the shape obtained by projecting the toner particle in a two-dimensional plane is divided by a graphic area AREA and is then multiplied by 100Π/4 to obtain the value of the shape factor SF-2.

$$SF\text{-}2=\{(PERI)^2/\mathrm{AREA}\}\times(100\Pi/4) \quad (2)$$

When the value of SF-2 is equal to 100, there is no unevenness on the surface of the toner particle, and as the value of SF-2 decreases, the surface unevenness of the toner particle becomes more conspicuous.

The shape factor was measured by taking a picture of the toner particle with a scanning electron microscope (S-800 manufactured by HITACHI SEISAKUSHO), analyzing it with an image analyzer (LUSEX3 manufactured by NIRECO CO., LTD.), and calculating the shape factor.

The toner particles preferably have the shape factor SF-1 in a range of 100 to 180 and the shape factor SF-2 in a range of 100 to 180. When the shape of the toner particles is closer to the circular shape, the contact of the toner particle with other toner particle or the contact of the toner particle with the photoconductive body 3 is a point contact, which improve the fluidity of the toner. Thus, the mutual adhesion of toner particles weakens and the fluidity is improved, thereby improving the transfer efficiency and facilitating the cleaning of the residual toner on the photoconductive body 3.

Therefore, the shape factors SF-1 and SF-2 are preferably 100 or greater. Furthermore, as the shape factors SF-1 and SF-2 increase, the toner particle shape becomes indefinite, the charging distribution of the toner widens, the development no longer becomes faithful with respect to the latent image, and the transfer no longer becomes faithful with respect to the transfer electric field, thereby deteriorating the image quality. In addition, the transfer efficiency deteriorates and the residual toner after the transfer increases, thereby requiring a large cleaning module 6, which is undesirable from the point of view of designing the image forming apparatus 100. For this reason, the shape factors SF-1 and SF-2 preferably do not exceed 180.

Figure 29A:
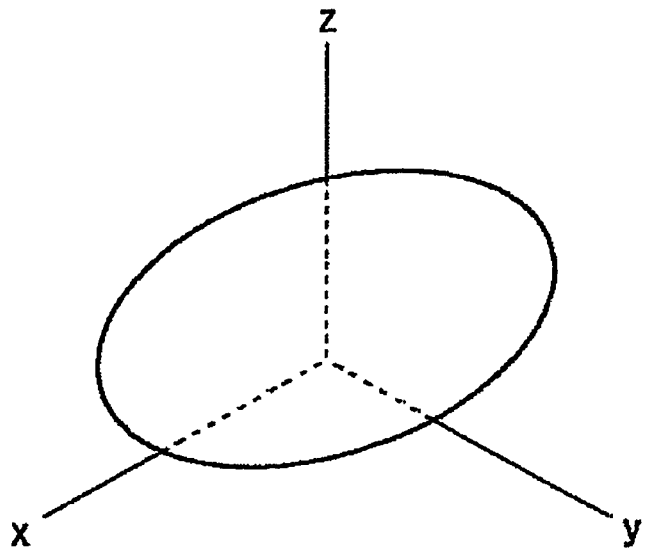
FIG. 29A is a perspective view showing a general shape of the toner, and FIGS. 29B and 29C respectively are cross sectional views of the toner cut along an x-z plane and a y-z plane.
Figure 29B:
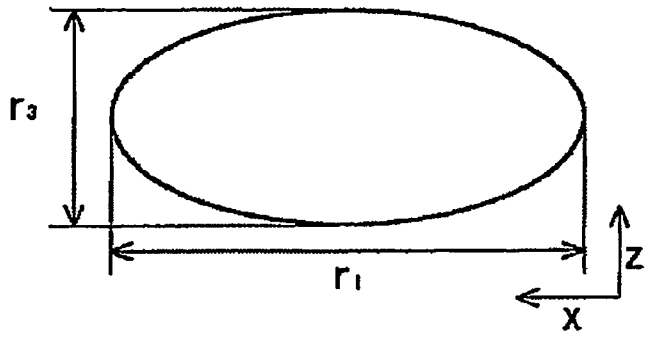
Figure 29C:
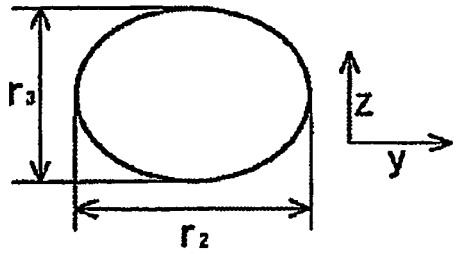

The toner particles may be spherical in shape and can be expressed in terms of the following shape regulation. FIGS. 29A through 29C are diagrams for explaining the shapes of the toner particles. FIG. 29A is a perspective view showing a general shape of the toner, and FIGS. 29B and 29C respectively are cross sectional views of the toner cut along an x-z plane and a y-z plane.

In FIGS. 29A through 29C, when the roughly spherical toner particles are regulated by a major axis r1, a minor axis r2 and a thickness r3 (provided that r1≧r2≧r3), a ratio r2/r1 of the major axis r1 and the minor axis r2 (see FIG. 29B) is preferably in a range of 0.5 to 1.0 and a ratio r3/r2 of the thickness r3 and the minor axis r2 (see FIG. 9C) is preferably in a range of 0.7 to 1.0. If the ratio r2/r1 is less than 0.5, the charging distribution widens because the toner particle shape becomes more indefinite. Moreover, if the ratio r3/r2 is less than 0.7, the charging distribution of the toner particles widens because the toner particle shape becomes more indefinite. Particularly, if the ratio r3/r2 is 1.0, the charging distribution of the toner particles becomes narrow since the toner particle shape becomes approximately spherical.

The toner particle size was measured by a scanning electron microscope (SEM) by taking pictures by changing an angle of field of vision and while observing.

The toner particle shape can be controlled by the manufacturing method. For example, in the case of the toner that is manufactured by dry grinding, the surface of the toner particles is uneven and the toner particle shape is indefinite. By even such a toner manufactured by the dry grinding can be formed can be adjusted by a thermal or mechanical process which shapes the toner particles into approximately spherical shapes which are close to true spherical shapes. The toner particles manufactured by forming droplets by suspension polymerization method or emulsion polymerization method have a smooth surface and an approximately spherical shape close to a true spherical shape. In addition, the toner particles can be made rugby ball shaped by applying a shearing force by strongly agitating the toner particles during a reaction process within a solvent.

The approximately (or roughly) spherical toner particles are preferably made by subjecting a toner material solution to a cross linking reaction and/or an extension reaction within an aqueous medium, where the toner material solution is obtained by dissolving or dispersing, within an organic solvent, at least a polyester prepolymer having a functional group that includes nitrogen atoms, a polyester, a colorant and a mold releasing agent.

A description will now be given of the constituent elements of the toner and the preferable manufacturing method thereof.

The toner in this embodiment contains modified polyester (i) as a binder resin. Modified polyester means a polyester in which there is a bonding group present other than an ester-bond in the polyester resin and resinous principles having a different structure in the polyester resin are bonded by a bond like covalent bond and ion bond. More particularly, it means a polyester terminal that is modified by introducing a functional group like an isocyanate group that reacts with a carboxylic acid group, a hydroxyl group to a polyester terminal and then allowed to react with a compound containing active hydrogen.

The examine of the modified polyester (i) is an urea modified polyester that is obtained by allowing to react a polyester prepolymer (A) having an isocyanate group with an amine (B). Examples of the polyester prepolymer (A) having the isocyanate group are condensates of polyhydric alcohols (PO) and polyhydric carboxylic acids (PC) and furthermore polyester prepolymers obtained by allowing to react a polyester having an active hydrogen group with a polyhydric isocyanate compound (PIC). The examines of the active hydrogen groups are hydroxyl groups (alcoholic hydroxyl group and phenolic hydroxyl group), amino group, carboxyl group, mercapto group, among which the alcoholic hydroxyl group is desirable.

The urea modified polymer is prepared as given below. Examples of the polyhydric alcohol compounds (PO) are dihydric alcohols (DIO) and polyhydric alcohols not below trihydric alcohol (TO). Solely the dihydric alcohol (DIO) or a mixture of a small quantity of trihydric alcohol (TO) with a dihydric alcohol (DI) is desirable. Examples of the dihydric alcohol (DIO) are, alkylene glycols (e.g. ethylene glycol, 1,2-propylene glycol, 1,3-propylene glycol, 1,4-butanediol, and 1,6-hexanediol), alkylene ether glycols (e.g. diethylene glycol, triethylene glycol, dipropylene glycol, polyethylene glycol, polypropylene glycol, and polytetramethylene ether glycol), alicyclic diols (e.g. 1,4-cyclohexane dimethanol, and hydrogen additive bisphenol A), bisphenols (e.g. biphenol A, biphenol F, and bisphenol S), adducts of alkylene oxides of these alicyclic diols (e.g. ethylene oxides, propylene oxides, and butylenes oxides), and adducts of alkylene oxides of the phenols (e.g. ethylene oxides, propylene oxides, and butylenes oxides). Adducts of alkylene oxides of the bisphenols and alkylene glycols having a carbon number from 2 to 12 are desirable. The adducts of alkylene oxides of bisphenols and the adducts of alkylene oxides of bisphenols together with the alkylene glycols having a carbon number from 2 to 12 are particularly desirable. Examples of the polyhydric alcohols not below trivalent alcohols (TO) are polyhydric aliphatic alcohols from trivalent to octavalent alcohols and above (e.g. glycerin, trimethylol ethane, trimethylol propane, pentaerythritol, and sorbitol), phenols not below trivalent phenols (e.g. trisphenol PA, phenol novolak, and cresol novolak), and adducts of alkylene oxides of polyphenols not below trivalent polyphenols.

Examples of the polyhydric carboxylic acid (PC) are dihydric carboxylic acid (DIC) and poly hydric carboxylic acids not below trivalent carboxylic acid (TC). Solely the dihydric carboxylic acid (DIC) or a mixture of a small quantity of trihydric carboxylic acid (TC) with a dihydric carboxylic acid (DIC) are desirable. The examines of dihydric carboxylic acid are alkylene dicarboxylic acids (e.g. succinic acid, adipic acid, and sebacic acid), alkenylene dicarboxylic acids (e.g. maleic acid, and fumaric acid), and aromatic dicarboxylic acids (e.g. phthalic acid, isophthalic acid, terephthalic acid, and naphthaline dicarboxylic acid). Among these, the alkenylene dicarboxylic acids having a carbon number from 4 to 20 and the aromatic dicarboxylic acids having a carbon number from 8 to 20 are desirable. The examines of the polyhydric carboxylic acids not below the trivalent carboxylic acid are aromatic polyhydric carboxylic acids having a carbon number from 9 to 20 (e.g. trimellitic acid and pyromellitic acid). The acid anhydrides and low alkyl esters of these can be used as polyhydric carboxylic acids and may be allowed to react with the polyhydric alcohols (PO).

The ratio of the polyhydric alcohol (PO) and the polyhydric carboxylic acid (PC) is an equivalent ratio [OH][COOH] of a hydroxyl group [OH] and a carboxyl group [COOH] and is generally in a range of 2/1 to 1/1. The desirable ratio is in a range of 1.5/1 to 1/1 and a range of 1.3/1 to 1.02/1 is particularly desirable.

The polycondensation reaction of the polyhydric alcohol (PO) and the polyhydric carboxylic acid (PC) is made in the presence of a known esterification catalyst such as tetrabutoxytitanate and dibutyl tin oxide, by heating to a temperature of 150° C. to 280° C., while carrying out vacuum distillation of water if necessary, so as to obtain a polyester having a hydroxyl group. The hydroxyl value of the polyester is preferably 5 or greater, and the acid value of the polyester is normally in a range of 1 to 30, and preferably in a range of 5 to 20. By making the polyester have such an acid value, the polyester can easily have negative electrification. In addition when fixing the toner image on the recording medium, the affinity of the toner and the recording medium improves, to thereby improve the fixing at the low temperature. But when the acid value exceeds 30, the electrification stability tends to deteriorate particularly with respect to an environmental change.

The weight average molecular weight of the polyester is in a range of 10,000 to 400,000, and preferably in a range of 20,000 to 200,000. The weight average molecular weight less than 10,000 is undesirable in that the offset resistance deteriorates. Further, weight average molecular weight exceeding 400,000 is undesirable in that the fixing at the low temperature deteriorates.

In addition to the non-modified polyester obtained by the polycondensation reaction described above, the polyester preferably includes urea-modified polyester. The urea-modified polyester may be obtained by allowing the carboxyl group, the hydroxyl group, etc. of the terminal functional group of the polyester that is obtained by the polycondensation reaction described above to react with the polyhydric isocyanate compound (PIC), so as to obtain the polyester prepolymer (A) having the isocyanate group, and allowing it to react with amines, resulting in the cross linking reaction and/or extension reaction of the molecular chain.

Examples of the polyhydric isocyanate compounds (PIC) are aliphatic polyhydric isocyanates (e.g. tetramethylene diisocyanate, hexamethylene diisocyanate, and 2,6-diisocyanate methyl caproate), alicyclic polyisocyanates (e.g. isophorone diisocyanate and cyclohexylmethane diisocyanate), aromatic diisocyanates (e.g. tolylene diisocyanate and diphenyl methane diisocyanate), aromatic aliphatic diisocyanates (e.g. $\alpha,\alpha,\alpha',\alpha'$-tetramethyl xylynene diisocyanate), isocyanates, compounds formed by blocking these polyisocyanates by a phenol derivative, an oxime, and caprolactum, and a combination of more than any one of these.

The ratio of the polyhydric isocyanate compound (PIC) is an equivalent ratio [NCO]/[OH] of an isocyanate group [NCO] and a hydroxyl group [OH] of a polyester and is generally in a range of 5/1 to 1/1. The desirable ratio is in a range of 4/1 to 1.2/1 and a range of 2.5/1 to 1.5/1 is particularly desirable. If the ratio [NCO]/[OH] is more than 5, the fixing of an image at a low temperature is affected. If the mole ratio of [NCO] is less than 1, in a case where urea non-modified polyester is used, the urea content in the ester becomes low, thereby affecting the offset resistance.

The content of the polyhydric isocyanate compound (PIC) in the polyester prepolymer (A) having an isocyanate group, is normally in a range of 0.5 weight percent to 40 weight percent. The desirable range of the content of the polyhydric isocyanate compound is 1 weight percent to 30 weight percent and a range of 2 weight percent to 20 weight percent is more desirable. If the content of the polyhydric isocyanate compound is less than 0.5 weight percent, the hot offset resistance is deteriorated and it is unfavorable from the point of view of compatibility of heat conserving resistance and fixing at the low temperature. On the other hand, if the content of the polyhydric isocyanate compound is more than 40 weight percent, there is a deterioration of fixing at the low temperature.

The content of the isocyanate group per molecule in the polyester prepolymer (A) having an isocyanate group is normally 1. The desirable range of the content of the isocyanate group is on average 1.5 to 3 and a range of 1.8 to 2.5 is more desirable. If the content of the isocyanate group per molecule is less than 1, then the molecular weight of the urea-modified polyester becomes low and the hot offset resistance is deteriorated.

Further, examples of amines (B) that are allowed to react with the polyester prepolymers (A) are hydric amine compounds (B1), polyhydric amine compounds (B2) not below trivalent amines, amino alcohols (B3), amino mercaptans (B4), amino acids (B5), and compounds (B6) in which the amino groups from B1 to B5 are blocked.

Examples of the dihydric amine compounds (B1) are aromatic diamines (e.g. phenylene diamine, diethylene diamine, and 4,4'-diamino diphenyl methane), acrylic diamines (e.g. 4,4'-diamino-3,3'-dimethyl dicyclohexyl methane, diamine cyclohexane, and isophorone diamine), and aliphatic diamines (e.g. ethylene diamine, tetramethylene diamine, and hexamethylene diamine). Examples of the polyhydric amine compounds (B2) not below trivalent amine are diethylene triamine and triethylene tetramine. Examples of the amino alcohols (B3) are ethanol amine and hydroxyethyl aniline. Examples of the amino mercaptans (B4) are amino ethyl mercaptan and amino propyl mercaptan. Examples of amino acids (B5) are amino propionic acid and amino caproic acid. Examples of the compounds (B6) in which the amino groups from B1 to B5 are blocked are ketimine compound and oxazolidine compounds obtained from the ketones and amines in B1 to B5 above (e.g. acetone, methyl ethyl ketone, and methyl isobutyl ketone). The desirable amines among the amines (B) are B1 and mixtures of B1 with a small amount of B2.

The ratio of amines is an equivalent ratio [NCO]/[NHx] of an isocyanate group [NCO] in the polyester prepolymers (A) having an isocyanate group and an amine group [NHx] in the amines (B) and is generally in a range of 1/2 to 2/1. The desirable ratio is in a range of 1.5/1 to 1/1.5 and a range of 1.2/1 to 1/1.2 is particularly desirable. If the ratio [NCO]/[NHx] is more than 2 or less than ½, the molecular weight of the urea-modified polyester decreases and the hot offset resistance is deteriorated.

Moreover, an urethane bond may be included together with an urea bond in the urea-modified polyester. The mole ratio of the urea bond content and the urethane bond content is normally in a range of 100/0 to 10/90. The desirable ratio is in a range of 80/20 to 20/80 and a range of 60/40 to 30/70 is more desirable. If the mole ratio of the urea bond is less than 10 percent, the hot offset resistance is deteriorated.

The urea-modified polyester (i) may be manufactured by a method like a one-shot method and a prepolymer method. The polyhydric alcohol (PO) and the polyhydric carboxylic acid (PC) are heated to a temperature of 150° C. to 280° C. in the presence of a known esterification catalyst such as tetrabutoxytitanate and dibutyl tin oxide, while carrying out vacuum distillation of water if necessary, so as to obtain the polyester having the hydroxyl group. Then, the polyhydric isocyanate compound (PIC) is allowed to react at a temperature of 40° C. to 140° C., so as to obtain the polyester prepolymer (A) having the isocyanate group. Further, the amine (B) is allowed to react with the polyester prepolymer (A) at a temperature of 0° C. to 140° C., so as to obtain the urea-modified polyester.

When allowing the polyhydric isocyanate compound (PIC) to react with the polyester having the hydroxyl group, and when allowing the polyester prepolymer (A) to react with the amine (B), it is possible to use a solvent if necessary. The usable solvent includes aromatic solvents (toluene, xylene etc.), ketones (acetone, methyl ethyl ketone, methyl isobutyl ketone, etc.), esters (acetic ester, etc.), amides (dimethyl formamide, dimethyl acetoamide, etc.), and ethers (tegrahydroduran, etc.), which are inert with respect to the polyhydric isocyanate compound (PIC).

A reaction inhibitor can be used if necessary in the cross linking reaction and/or extension reaction between the polyester prepolymer (A) and the amine (B), so as to adjust the molecular weight of the urea-modified polyester that is obtained. Examples of the reaction inhibitors are monoamines (e.g. diethyl amine, dibutyl amine, butyl amine, lauryl amine, etc.) and the compounds in which these are blocked (e.g. ketimine compounds).

The weight average molecular weight of the modified polyester (i) is normally not less than 10,000. The desirable weight average molecular weight is in a range of 20,000 to 10,000,000 and the weight average molecular weight in a range of 30,000 to 1,000,000 is more desirable. Here, the desirable range of the peak molecular weight is 1,000 to 10,000. If it is less than 1,000, it becomes difficult to carry out the extension reaction due to which the elasticity of the toner is low, thereby deteriorating the hot offset resistance. If the peak molecular weight is more than 10,000, the fixing of the image is deteriorated and there are problems in manufacturing regarding small particle size and pulverization. The number average molecular weight of the modified polyester (i) is not restricted only in a case of using the non-modified polyester (ii) than will be described later and may be a number average molecular weight that is suitable to obtain the weight average molecular weight. If the modified polyester (i) is used solely, the number average molecular weight is normally not more than 20,000 and is desirably in a range of 1,000 to 10,000. A range of 2,000 to 8,000 is more desirable. If the number average molecular weight is more than 20,000, the fixing at the low temperature and the gloss when a full-color unit is used, are deteriorated.

A reaction inhibitor can be used if necessary in cross linking reaction and/or extension reaction between the polyester prepolymer (A) and the amine (B) to obtain a modified polyester (i), to adjust the molecular weight of the urea-modified polyester that is obtained. Examples of the reaction inhibitors are monoamines (e.g. diethyl amine, dibutyl amine, butyl amine, and lauryl amine) and the compounds in which these are blocked (e.g. ketimine compounds).

The modified polyester (i) can not only be used solely but also can be mixed together with a non-modified polyester (ii) contained as a binder resinous principle. By using (ii) together with (i), there is an improvement in the fixing at the low temperature and the gloss when a full-color unit is used. Therefore, the use of (i) together with (ii) is desirable than using (i) solely. Examples of (ii) are polycondensates of polyhydric alcohols (PC) and polyhydric carboxylic acids (PC) similar to the polyester component of (i). Moreover, (ii) is not limited to non-modified polyester and may be a compound modified by a chemical bond other than the urea bond like a component modified by an urethane bond. From the point of view of the fixing at the low temperature and the hot offset resistance, it is desirable that (i) and (ii) are at least partly compatible. Therefore, it is desirable that (ii) and the polyester component of (i) have similar composition. The weight ratio of (i) and (ii) when (ii) is included in (i), is normally in a range of 5/95 to 80/20. The weight ratio in a range of 5/95 to 30/70 is desirable and a range of 5/95 to 25/75 is more desirable. The weight ratio in a range of 7/93 to 20/80 is further more desirable. If the weight ratio of (i) is less than 5 percent, the hot offset resistance is deteriorated and it is unfavorable from the point of view of compatibility of heat conserving resistance and fixing at the low temperature.

The peak molecular weight of (ii) is normally in a range of 1,000 to 10,000. The desirable range is from 2,000 to 8,000 and a range of 2,000 to 5,000 is more desirable. If the peak molecular weight is less than 1,000, the heat conserving resistance is deteriorated and if it is less than 10,000, the fixing at the low temperature is deteriorated. It is desirable that the hydroxyl value of (ii) is not less than 5. The value in a range of 10 to 120 is more desirable and a range of 20 to 80 is particularly desirable for the hydroxyl value of (ii). If the hydroxyl value is less than 5, it is unfavorable from the point of view of compatibility of the heat conserving resistance and the fixing at the low temperature. It is desirable that the acid value of (ii) is in a range of 1 to 5 and a range of 2 to 4 is more desirable. Since a wax having a high acid value is used, the binder is a low acid value binder resulting in charging and high volume resistance. Therefore, it is easy to match the binder that matches with the toner that is used in a two-component developer.

The glass transition point (Tg) of a binder resin is normally in a range of 45° C. to 65° C. and the desirable range is from 45° C. to 60° C. If the glass transition point (Tg) is less than 45° C., the heat conserving resistance of the toner is deteriorated and if it is more than 65° C., the fixing at the low temperature is insufficient.

Since the urea-modified polyester tend to exist on the surface of the host particles of the toner obtained, even if the glass transition point (Tg) is lower as compared to tat of the known polyester-based toners, it has a tendency to have good heat conserving resistance.

Known materials may be suitably selected for the colorant, charge controlling agent, the mold release agent and the like.

A description will be given of a method of manufacturing the toner. The method described hereunder is a desirable method, and the manufacturing method of the toner is not limited to such.

The method of manufacturing the toner includes the following steps.

1) A toner material solution is prepared by allowing to disperse a colorant, a non-modified polyester, a polyester prepolymer having an isocyanate group, and a mold releasing agent in an organic solvent. It is desirable to have a volatile organic solvent having a boiling point below 100° C. since the removal after forming of the host particles of the toner is facilitated. More particularly, toluene, xylene, benzene, carbon tetrachloride, methylene chloride, 1,2-dichloromethane, 1,2,2-trichloromethane, trichloroethylene, chloroform, monochlorobenzene, dichloroethylidine, methyl acetate, ethyl acetate, methyl ethyl ketone, methyl isobutyl ketone etc. can be used solely or a combination of two or more of these may be used. Aromatic solvents of toluene, xylene etc. and halogen hydrocarbons of methylene chloride, 1,2-dichloroethane, chloroform, carbon tetrachloride etc. are particularly desirable. The amount of the organic solvent to be used is normally in a range of 0 to 300 parts of weight per 100 parts of weight of polyester prepolymer. The desirable amount is in a range of 0 to 100 parts of weight and a range of 25 to 70 parts of weight is more desirable.

2) The toner material solution is emulsified in an aqueous medium in the presence of a surfactant and fine particles of resin. An aqueous medium may be solely water or an aqueous medium containing an organic solvent like an alcohol (methanol, isopropyl alcohol, ethylene glycol, etc.), dimethyl formamide, tetrahydrofuran, cellosorb (methyl cellosorb, etc.), and lower ketone (acetone, methyl ethyl ketone, etc.).

The amount to be used of an aqueous medium per 100 parts of weight of the toner material solution is normally in a range of 50 to 2,000 parts of weight and it is desirable to have this amount in a range of 100 to 1,000 parts of weight. If the amount is less than 50 parts of weight, it affects the dispersion of the toner material solution and toner particles of a predetermined particle size cannot be obtained. An amount of more than 20,000 weight parts is not economical.

Further, to improve the dispersion in the aqueous medium, an appropriate dispersing agent like a surfactant, and fine particles of resin are added.

Examples of the surfactants are anionic surfactants like alkyl benzene sulfonate, α-olefin sulfonate, ester phosphate, amine salts like alkyl amine salt, amino alcohol fatty acid derivatives, polyamine fatty acid derivatives, imidazoline, cationic surfactants of quaternary ammonium salt types like alkyl trimethyl ammonium salts, dialkyl dimethyl ammonium salts, alkyl dimethyl benzyl ammonium salts, pyridinium salts, alkyl isoquinolinium salts, benzethonium chloride, nonionic surfactants of fatty acid amide derivatives and polyhydric alcohol derivatives like alanine, dodecyl di (amino ethyl) glycine, di (octyl amino ethyl) glycine and ampholytic surfactants like N-alkyl-N,N-dimethyl ammonium betaine, etc.

Furthermore, by using a surfactant having a fluoroalkyl group, a desired effect can be achieved with a very small quantity. Examples of the desirable anionic surfactants having a fluoroalkyl group and fluoroalkyl carboxylic acids and their metal salts having a carbon number from 2 to 10, disodium perfluorooctane sulfonyl glutamate, sodium-3[ω-fluoroalkyl (C6 to C11) oxy]-1-alkyl (C3 to C4) sulfonate, sodium 3-[ω-fluoroalkanoyl (C6 to C8)-N-ethyl amino]-1-propane sulfonate, fluoroalkyl (C11 to C20) carboxylic acid and its metal salts, perfluoroalkyl carboxylic acid (C7 to C13) and its metal salts, perfluoroalkyl (C4 to C12) sulfonic acid and its metal salts, perfluorooctane sulfonic acid diethanol amide, N-Propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethyl sulfonyl glysine salts, ester mono-perfluoroalkyl (C6 to C10) ethyl phosphate.

Examples of commercial products available are SURFLON S-111, S-112, S-113 (manufactured by ASAHI GLASS CO., LTD.), FLUORAD FC-93, FC-95, FC-98, FC-129 (manufactured by SUMITOMO 3M Co., LTD.), UNIDINE DS-101, DS-102 (manufactured by DAIKIN INDUSTRIES, LTD.), MEGAFACE F-110, F-120, F-113, F-191, F-812, F-833 (manufactured by DAI NIPPON INK & CHEMICALS, INC.), EKTOP EF-102, 103, 104, 10 parachloro orthonitro aniline red, lithol fast scarlet G, brilliant fast scarlet, brilliant carmine BS, permanent 5, 112, 123A, 123B, 306A, 501, 201, and 204 (manufactured by TOCHEM PRODUCTS, CO., LTD.), and FTERGENT F-100 and F-150 (manufactured by NEOS CO., LTD.).

Examples of cationic surfactants are primary aliphatic acids, secondary aliphatic acids or secondary amino acids having a fluoroalkyl group, quaternary aliphatic ammonium salts like perfluoroalkyl (C6 to C10) suldonamide propyl trimethyl ammonium salts, etc., benzalkonium salts, benzethonium chloride, pyridinium salts, and imidazolinium salts. Examples of commercial products are SURFLON S-121 (manufactured by ASAHI GLASS CO., LTD.), FLUORAD FC-135 (manufactured by SUMITOMO 3M CO., LTD.), UNIDINE DS-202 (manufactured by DAIKIN INDUSTRIES, LTD.), MEGAFACE F-150, F-824 (manufactured by DAI NIPPON INK & CHEMICALS, INC.), EKTOP EF-132 (manufactured by TOCHEM PRODUCTS CO., LTD.), and FTERGENT F-300 (manufactured by NEOS CO., LTD.).

The fine particles of resin may be made of any kind of resin capable of forming an aqueous disperser, and a thermoplastic resin or a thermosetting resin may be used therefor. Examples of such resins include vinyl-based resin, polyurethane resin, epoxy resin, polyester resin, polyamide resin, polyamide resin, silicon-based resin, phenol resin, melamine resin, urea resin, aniline resin, iononer resin, polycarbonate resin and the like. Of course, a combination of two or more such resins may be used. From the point of view of the ease with which the aqueous disperser having fine spherical shaped resin particles are obtainable, the vinyl-based resin, the polyurethane resin, the epoxy resin, the polyester resin and a combination of two or more such resins is preferably used as the resin. Examples of the vinyl-based resins include polymers obtained by polymerization or copolymerization of vinyl-based monomers, such as styrene-(meta) ester acrylate copolymer, styrene-butadiene copolymer, (meta) acrylate-ester acrylate copolymer, styrene-acrylonitrile copolymer, styrene-maleic anhydride copolymer, styrene-(meta) acrylate copolymer and the like. The average particle size of the fine resin particles is in a range of 5 nm to 200 nm, and preferably in a range of 20 nm to 30 nm.

The fine particles of resin are added to stabilize the host particles of the toner that are formed in the aqueous medium. Therefore, it is desirable that the fine particles of rein are added to make 10 to 90 percent covering on the surface of the host particles of the toner. Examples are fine particles of methyl polymethacrylate having a particle size of 0.5 μm and 2 μm, fine particles of poly (styrene-acryl nitrile) having a particle size of 1 μm. Examples of commercial products are PB-200H (manufactured by KAO CORPORATION), SGP (manufactured by SOKEN CO., LTD.), TECHPOLYMER-SB (manufactured by SEKISUI CHEMICAL CO., LTD.), SGP-3G (manufactured by SOKEN CO., LTD.), and MICROPEARL (manufactured by SEKISUI CHEMICAL CO., LTD.). Moreover, inorganic dispersing agents like calcium phosphate-tribasic, calcium carbonate, titanium oxide, colloidal silica, and hydroxyapatite can also be used.

The dispersion droplets may be stabilized by a high polymer protective colloid as a dispersing agent that can be used both as fine particles of rein and of an inorganic dispersing agent. For example, acids like acrylic acid, methacrylic acid, α-cyanoacrylic acid, α-cyanomethacrylic acid, itanoic acid, crotonic acid, fumaric acid, maleic acid or anhydrous meleic acid, or (metha) acrylic monomers that include a hydroxyl group like β-hydroxyethyk acrylate, β-hydroxyethyl methacrylate, β-hydroxypropyl acrylate, β-hydroxypropyl methacrylate, γ-hydroxypropyl acrylate, γ-hydroxyproly methacrylate, 3-chloro 2-hydroxypropyl acrylate, 3-chloro 2-hydroxypropyl methacrylate, diethylene glycol monoacrylic ester, diethylene glycol monomethacrylic ester, glycerin monoacrylic ester, glycerin monomethacrylic ester, N-methylol acryl amide, N-methylol methacryl amide, vinyl alcohols or ethers of vinyl alcohols like vinyl methyl ester, vinyl ethyl ether, vinyl propyl ether, or esters of compounds that include vinyl alcohol or a carboxyl group like vinyl acetate, vinyl propionate, vinyl butyrate, acryl amides, methacryl amides, diacetone acryl amide or their methylol compounds, acid chlorides like an acrylic acid chloride, a methacrylic acid chloride, nitrogenous substances like vinyl pyridine, vinyl pyrrolidine, vinyl imidazole, ethylene imines and homopolymers or copolymers of compounds having the heterocycles of these substances, polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester, celluloses like methyl cellulose, hydroxyethyl cellulose, hydroxypropyl cellulose, etc. are used.

The dispersion method is not limited to a particular method, and a known apparatus like a low-speed shearing disperser, a high-speed shearing disperser, friction disperser, high-pressure jet disperser, and ultrasonic disperser can be used. Among these, the high-speed shearing disperser is desirable to make the particle size of a dispersing element from 2 μm to 20 μm. If the high-speed shearing is used, the number of revolutions per minute (rpm) is not limited to a certain value, but is normally in a range of 1,000 rpm to 30,000 rpm. The desirable range of the number of revolutions per minute is 5,000 rpm to 20,000 rpm. The dispersing time is not limited to a particular value. However, in a case of batch dispersion, the dispersing time is normally in a range of 0.1 minute to 5 minutes. The temperature during the dispersion is normally in a range of 0° C. to 150° C. (under pressure) and the desirable range of the temperature is 40° C. to 98° C.

3) While preparing an emulsified liquid, amine (B) is added and a reaction is allowed to take place with a polyester prepolymer (A) having an isocyanate group. This reaction involves a cross linking reaction and/or extension reaction of a molecular chain. The reaction time is selected according to the reactivity of the amine (B) with a structure of an isocyanate group of the polyester prepolymer (A) and is normally in a range of 10 minutes to 40 hours. The desirable reaction time is in a range of 2 hours to 24 hours. The reaction temperature is normally in a range of 0° C. to 150° C. and the desirable temperature is from 40° C. to 98° C. Moreover, a known catalyst can be used according to the requirement. Particular examples of the catalyst are dibutyl tin laurate and dioctyl tin laurate.

4) On completion of the reaction, the organic solvent is removed from the emulsified dispersing element (reaction compound), washed, and dried to obtain the host particles of the toner. To remove the organic solvent, the whole system is heated up while laminar flow stirring. Around a particular temperature, the mixture is stirred vigorously and then the fusiform host particles of the toner are prepared by carrying out diliquoring. Further, if a compound like a calcium phosphate salt that dissolves in an acid or an alkali is used as a dispersion stabilizer, after the calcium phosphate salt is dissolved in an acid like hydrochloric acid, the calcium phosphate salt is removed from the host particles of the toner according to a method of cleaning. It can also be removed by decomposition by an enzyme.

5) A charge controlling agent is penetrated into the host particles of the toner thus obtained, and inorganic fine particles like those of silica, titanium oxide, etc. are added externally to obtain the toner. The penetrating of the charge controlling agent and the addition of the inorganic fine particles are carried out by a known method using a mixer, etc. Thus, a toner having a sharp particle size distribution and with a small particle size, can be obtained easily. Moreover, by vigorous stirring for removing the organic solvent, the shape of particles from perfectly spherical to rugby ball shape can be controlled. Furthermore, the morphology of the particle surface can also be controlled between the smooth and the rough.

Inorganic fine particles may be used as an external additive to assist the fluidity, the developing and the charging of the toner particles. Hydrophobic silica and/or hydrophobic titanium oxide fine particles are particularly desirable for use as the inorganic fine particles. A primary particle size of the inorganic fine particles is in a range of $5\times10^{-3}$ μm to 2 μm, and more desirably in a range of $5\times10^{-3}$ μm to 0.5 μm. Further, it is desirable that a specific surface area according to the BET method is in a range of 20 $m^2/g$ to 500 $m^2/g$. It is desirable that the proportion of the inorganic fine particles to be used is in a range of 0.01 weight percent to 5 weight percent of the toner and a range of 0.01 weight percent to 2.0 weight percent is particularly desirable.

Other examples of the inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium ocide, ceric oxide, red ocide, antimony trioxide, magnesium oxide, zirconium oxide, barium sulfate, barium carbonate, calcium carbonate, silicon carbide and silicon nitride. Other examples of the inorganic fine particles include polymer fine particles such as soap-free emulsion polymers and suspension polymers, polystyrene, ester metacrylate and ester acrylate copolymers obtained by dispersion polymerization, polycondensates such as silicone, benzoguanamine and nylon, and thermosetting resin.

The surface treating by the surfactant improves the hydrophobic characteristic, and prevents deterioration of the fluidity and charging characteristic even under a high humidity. Examples of suitable surfactants include silane coupling agent, sillilation reagent, silane coupling agent having fluoride alkyl group, organic titanate-based coupling agent, aluminum-based coupling agent, silicone oil, and denaturated silicone oil.

The toner described above may be mixed with a magnetic carrier and used as a two-component developer. In this case, the toner density with respect to the magnetic carrier within the developer is preferably in a range of 1 to 10 parts of weight per 100 parts of weight of the magnetic carrier. In addition, the toner described above may be used as a one-component magnetic toner or non-magnetic toner that codes not use a carrier.

Further, the present invention is not limited to these embodiments, but various variations and modifications may be made without departing from the scope of the present invention.

The invention claimed is:

1. A process cartridge comprising:

a frame body made up of at least first and second frame bodies that are movable relative to each other to form a space in an open state and to close the space in a closed state;

a frame body positioning member positioning the first and second frame bodies;

a latent image bearing member, supported by the frame body, and replaceable in a first direction via the space formed by the first and second frame bodies;

a developing unit supplying a developing agent to the latent image bearing member, the developing unit configured to be replaceable in the closed state in a second direction substantially perpendicular to the first direction via a space different than the space formed by the first and second frame bodies; and a developing position determining member, disposed at a non-overlapping position relative to the frame body positioning member, and positioning the developing unit with respect to the frame body;

a cleaning unit cleaning residual toner on the latent image bearing member; and a cleaning position determining member positioning the cleaning unit with respect to the frame body, said cleaning unit being replaceable via the space formed by the first and second frame bodies, wherein said cleaning unit comprises a cleaning blade removing residual toner on at least the latent image bearing member, a bias roller controlling an amount of charge of the residual toner, and a recovery roller recovering toner adhered on the bias roller and the cleaning blade, said cleaning position determining member comprises a blade positioning member positioning the cleaning blade with respect to the frame body, the bias roller and the recovery roller, and said cleaning blade, said bias roller and said recovery roller are independently replaceable.

2. The process cartridge as claimed in claim 1, wherein said developing unit comprises a developing agent bearing member transporting the developing agent, and a magnet group provided inside the developing agent bearing member, and having a predetermined main pole direction; and said developing position determining member comprises a positioning member positioning the latent image bearing member and the developing agent bearing member, and an angular positioning member determining the main pole direction of the magnet group with respect to the latent image bearing member.

3. The process cartridge as claimed in claim 1, further comprising:

a charging unit uniformly charging the latent image bearing member, said charging unit being positioned with respect to the frame body at an non-overlapping position relative to the frame body position determining member, the developing position determining member and a cleaning position determining member.

4. The process cartridge as claimed in claim 1, wherein at least one of the latent image bearing member, the cleaning unit, the charging unit and the developing unit is replaced after removing the process cartridge from a main body of an image forming apparatus.

5. The process cartridge as claimed in claim 1, wherein the latent image bearing member is inserted with a driving shaft provided in a main body of an image forming apparatus.

6. The process cartridge as claimed in claim 5, wherein the frame body has a hole part for receiving the driving shaft.

7. The process cartridge as claimed in claim 1, wherein said frame body comprises a discharge unit and a detection unit.

8. The process cartridge as claimed in claim 7, wherein said discharge unit comprises an electroluminescence lamp.

9. The process cartridge as claimed in claim 7, wherein said detection unit comprises a potential sensor detecting a potential of the latent image bearing member, a toner density sensor detecting an amount of toner on the latent image bearing member, and a temperature and humidity sensor detecting a temperature and a humidity within the process cartridge.

10. The process cartridge as claimed in claim 1, wherein electrical wirings for external connection are connectable via one location of the process cartridge.

11. The process cartridge as claimed in claim 1, wherein said developing unit is packed with a toner having an average circularity in a range of 0.93 to 1.00.

12. The process cartridge as claimed in claim 1, wherein said developing unit is packed with a toner that has an average circularity in a range of 0.93 to 1.00 and a ratio of volume average particle size and a number average particle size in a range of 1.05 to 1.40.

13. The process cartridge as claimed in claim 1, wherein said developing unit is packed with a toner that has an average circularity in a range of 0.93 to 1.00 and is made up of roughly spherical particles with a ratio $r2/r1$ of a minor axis $r2$ and a major axis $r1$ in a range of 0.5 to 1.0, a ratio $r3/r2$ of a thickness $r3$ and the minor axis $r2$ in a range of 0.7 to 1.0, and satisfying a relationship $r1 \geqq r2 \geqq r3$.

14. The process cartridge as claimed in claim 1, wherein said developing unit is packed with a toner that has an average circularity in a range of 0.93 to 1.00 and is made by subjecting a toner material solution to a cross linking reaction and/or an extension reaction within an aqueous medium, where the toner material solution is obtained by dissolving or dispersing, within an organic solvent, at least a polyester prepolymer having a functional group that includes nitrogen atoms, a polyester, a colorant and a mold releasing agent.

15. The process cartridge as claimed in claim 1, further comprising:

an accommodating part accommodating a toner or a newly supplied toner.

16. The process cartridge as claimed in claim 1, which is reusable by receiving a supply of toner.

17. The process cartridge as claimed in claim 16, further comprising:

an accommodating part accommodating a supplied toner.

18. An image forming apparatus for visualizing a latent image formed on a latent image bearing member into a toner image, comprising:

at least one detachable process cartridge according to claim 1, at least one of the latent image bearing member and the developing unit being replaceable with respect to the process cartridge.

19. The image forming apparatus as claimed in claim 18, further comprising:

an accommodating part accommodating a supplied toner.

20. A process cartridge comprising:

a frame body made up of at least a first frame body and a second frame body that are movable relative to each other to form a space;

a latent image bearing member supported by the frame body and replaceable in a first direction via the space formed by the first and second frame bodies;

a developing unit supplying a toner to the latent image bearing member and configured to be replaceable in the process cartridge in a state in a second direction substantially perpendicular to the first direction where the latent image bearing member remains supported by the frame body;

a developing position determining member positioning the developing unit with respect to the frame body;

a cleaning unit cleaning the toner on the latent image bearing member and configured to be replaceable from the process cartridge;

a cleaning position determining member, disposed at a non-overlapping position relative to the developing position determining member, positioning the cleaning unit with respect to the frame body; and a frame body positioning member, disposed at a non-overlapping position relative to the developing position determining member, and positioning the first and second frame bodies, each of the developing unit and the cleaning unit is further configured to be positioned by only one of the first frame body or the second frame body, wherein:

said developing unit comprises a developing agent bearing member transporting a developing agent, and a magnet group provided inside the developing agent bearing member and having a predetermined main pole direction; and said developing position determining member comprises a positioning member positioning the latent image bearing member and the developing agent bearing member, and an angular positioning member determining the main pole direction of the magnet group with respect to the latent image bearing member.

21. The process cartridge as claimed in claim 20, wherein said cleaning unit is replaceable by removing the cleaning position determining member after the first and second frame bodies are moved relative to each other to form the space.

22. The process cartridge as claimed in claim 20, further comprising:

a charging unit uniformly charging the latent image bearing member, said charging unit being positioned with respect to the frame body at an non-overlapping position relative to the frame body position determining member, the developing position determining member and the cleaning position determining member.

23. An image forming apparatus for visualizing a latent image formed on a latent image bearing member into a toner image, comprising:

at least one detachable process cartridge according to claim 20, at least one of the latent image bearing member, the developing unit and the cleaning unit being replaceable with respect to the process cartridge.

24. The image forming apparatus as claimed in claim 23, further comprising:

an accommodating part accommodating a supplied toner.

25. The process cartridge as claimed in claim 20, wherein said developing position determining member positions a developing reference shaft of the developing unit with respect to a hole in the frame body forming a bearing.

26. The process cartridge as claimed in claim 20, wherein said latent image bearing member receives a driving shaft of the image forming apparatus when the process cartridge is loaded into the image forming apparatus.

27. The process cartridge as claimed in claim 26, wherein said frame body includes a hole forming a bearing and receiving the driving shaft of the image forming apparatus.

28. The process cartridge as claimed in claim 20, further comprising:

a discharge unit provided on the frame body; and a detection unit provided on the frame body.

29. The process cartridge as claimed in claim 28, wherein said detection unit comprises a potential sensor detecting a potential of the latent image bearing member, a toner density sensor detecting an amount of toner on the latent image bearing member, and a temperature and humidity sensor detecting a temperature and a humidity within the process cartridge.

30. The process cartridge as claimed in claim 20, further comprising:

an accommodating part accommodating a toner or a newly supplied toner.

31. The process cartridge as claimed in claim 20, which is reusable by receiving a supply of toner.

32. The process cartridge as claimed in claim 31, further comprising:

an accommodating part accommodating a supplied toner.

33. A process cartridge comprising:

a frame body made up of at least a first frame body and a second frame body that are movable relative to each other to form a space;

a latent image bearing member supported by the frame body and replaceable in a first direction via the space formed by the first and second frame bodies;

a developing unit supplying a toner to the latent image bearing member and configured to be replaceable in the process cartridge in a state in a second direction substantially perpendicular to the first direction where the latent image bearing member remains supported by the frame body;

a developing position determining member positioning the developing unit with respect to the frame body;

a cleaning unit cleaning the toner on the latent image bearing member and configured to be replaceable from the process cartridge;

a cleaning position determining member, disposed at a non-overlapping position relative to the developing position determining member, positioning the cleaning unit with respect to the frame body; and a frame body positioning member, disposed at a non-overlapping position relative to the developing position determining member, and positioning the first and second frame bodies, each of the developing unit and the cleaning unit is further configured to be positioned by only one of the first frame body or the second frame body, wherein:

said cleaning unit comprises a cleaning blade removing residual toner on at least the latent image bearing member, a bias roller controlling an amount of charge of the residual toner, and a recovery roller recovering toner adhered on the bias roller and the cleaning blade;

said cleaning position determining member comprises a blade positioning member positioning the cleaning blade with respect to the frame body, the bias roller and the recovery roller; and said cleaning blade, said bias roller and said recovery roller are independently replaceable.

34. The process cartridge as claimed in claim 33, wherein said cleaning unit further comprises a coating mechanism including a coating roller and a lubricant body, said coating mechanism coating a lubricant on the latent image bearing member.

35. The process cartridge as claimed in claim 34, wherein said lubricant body is replaceable.

* * * * *